US011525258B2

(12) United States Patent
Nanayakkara

(10) Patent No.: US 11,525,258 B2
(45) Date of Patent: Dec. 13, 2022

(54) MASONRY BLOCK ANCHOR SYSTEM

(71) Applicant: Pravin Nanayakkara, Boca Raton, FL (US)

(72) Inventor: Pravin Nanayakkara, Boca Raton, FL (US)

( * ) Notice: Subject to any disclaimer, the term of this patent is extended or adjusted under 35 U.S.C. 154(b) by 0 days.

(21) Appl. No.: 17/114,044

(22) Filed: Dec. 7, 2020

(65) Prior Publication Data

US 2022/0178137 A1 Jun. 9, 2022

(51) Int. Cl.
*E04B 2/18* (2006.01)
*E04C 1/00* (2006.01)
*E04B 2/02* (2006.01)

(52) U.S. Cl.
CPC ..... *E04B 2/18* (2013.01); *E04C 1/00* (2013.01); *E04B 2002/025* (2013.01)

(58) Field of Classification Search
CPC ..... E04B 2/18; E04B 2002/025; E04C 1/00
See application file for complete search history.

(56) References Cited

U.S. PATENT DOCUMENTS 1,894,605 A * 1/1933 Wright ..... A63H 33/04 D21/500
5,078,354 A * 1/1992 Kim ..... E04B 2/18 446/128
5,122,015 A * 6/1992 Shen ..... E02B 3/14 405/21
5,673,530 A * 10/1997 Bailey, II ..... E04B 2/18 52/562
5,911,539 A * 6/1999 Egan ..... E02D 29/0225 405/20
6,843,034 B2 * 1/2005 McDonald ..... E04B 2/16 52/564
6,912,819 B2 * 7/2005 Price ..... E04B 2/44 52/285.3
D600,821 S * 9/2009 Esterhuizen ..... E04B 2/18 D25/113
8,051,619 B2 * 11/2011 Hohmann, Jr. ..... E04G 21/1841 52/649.8
8,955,282 B2 * 2/2015 Yap Ching ..... E04B 2/24 52/562
10,724,240 B2 * 7/2020 Brandao ..... E04B 2/18
11,123,652 B2 * 9/2021 Haldeman ..... A63H 33/082
2003/0208981 A1 * 11/2003 Price ..... E04B 2/44 52/596
2003/0221386 A1 * 12/2003 McDonald ..... E04B 2/16 52/568
2008/0295440 A1 * 12/2008 Esterhuizen ..... E04B 2/18 52/606
2010/0101166 A1 * 4/2010 Hohmann, Jr. ..... E04G 21/1883 52/442

(Continued)

*Primary Examiner* — Rodney Mintz
(74) *Attorney, Agent, or Firm* — Melvin K. Silverman

(57) ABSTRACT

A system and method of masonry construction using masonry blocks and anchors, wherein the blocks are laid end to end, and an anchor is inserted between them. The anchor both spaces and secures the blocks, even before mortar is applied. The anchors contain legs recess between the walls of the masonry construction, and create a space for the walls to recess in to on the anchor, thereby providing multi-directional securement of the system. Embodiments of the system also contain grooves for additional securement and complemental engagement of the anchors.

14 Claims, 25 Drawing Sheets

(56) References Cited

U.S. PATENT DOCUMENTS

| | | | | |
|---|---|---|---|---|
| 2014/0331590 | A1* | 11/2014 | Goltsman | E04B 2/26 52/592.5 |
| 2017/0009452 | A1* | 1/2017 | Holtzapple | B28B 7/0002 |
| 2017/0121973 | A1* | 5/2017 | Brandao | E04C 1/00 |
| 2018/0328030 | A1* | 11/2018 | Walter | E04B 2/18 |
| 2020/0360831 | A1* | 11/2020 | Haldeman | A63H 33/082 |

* cited by examiner

MASONRY BLOCK ANCHOR SYSTEM

FIELD OF THE INVENTION

The present invention relates to an improvement in anchoring systems used masonry walls and masonry construction.

BACKGROUND OF THE INVENTION

Masonry is the construction of a structure by smaller units, such as masonry blocks, which are bonded together by mortar. Many modern building systems employ some use of masonry block construction. Typically this construction involves setting a row of masonry blocks, applying mortar, and stacking a plurality of masonry blocks row by row, typically staggering one row upon another as the rows increase. Reinforcement is typically accomplished with the use of vertical rebar and grout within a cavity of masonry blocks. Over the years several inventions have been developed to provide spacing and reinforcement for masonry construction.

One such invention for reinforcing spacers is Hohmann, J R's U.S. Patent Application, US 2010/0101166 A1 ("Hohmann"). As described, the application is directed to a reinforcing and spacing device for use with masonry wall structures. The spacer includes parallel side rods with interconnecting intermediate rods and spacing nodes disposed on the side rods and the intermediate rods. However, this invention is not easily portable between manufacturing and construction sites, and does not sufficiently anchor the blocks in multiple axial directions.

Thus, a need in the industry has arisen for a masonry block anchor system.

SUMMARY OF THE INVENTION

The present invention provides for a masonry system constructed of non-combustible material, having at least one anchor having three vertical legs attached to a central horizontal member, and two vertical legs attached to the central horizontal member extending in an opposite direction from the three vertical legs, wherein the three vertical legs include a central leg and two outer legs, wherein two vertical legs meet the central horizontal member at a connection point opposite of a spacing between the three vertical legs.

Further, included in the present invention is at least one block having four outer walls and one inner wall defining two internal vertical cavities, wherein the four outer walls include two sidewalls connected by two end walls, and the inner wall connecting to the two sidewalls.

The invention further provides that the three vertical legs of the at least one anchor are spaced apart from one another a complementary distance to a thickness of the end walls of the at least one block, and two vertical legs of the at least one anchor are spaced apart from one another a complementary distance to a thickness of the inner wall of the at least one block. Each of the at least one anchors includes two spaces, formed from space created between the inner leg and each of the outer legs, for recessing the end walls, and each of the at least one anchor includes one space, formed from space created between the two vertical legs, for recessing the inner wall of the at least one block The present invention provides for a method of using a 2-part masonry block anchor system in masonry construction by providing at least one block having four outer walls and one inner wall defining two internal vertical cavities, wherein the four outer walls comprise two sidewalls connected by two end walls, the inner wall connecting to the two sidewalls.

The method further includes providing at least one anchor having three vertical legs attached to a central horizontal member, and two vertical legs attached to the central horizontal member extending in an opposite direction from the three vertical legs, wherein the three vertical legs include a central leg and two outer legs, and the two vertical legs meet the central horizontal member at a connection point opposite of a spacing between the three vertical legs. The three vertical legs of the at least one anchor are spaced apart from one another a complementary distance to a thickness of the end walls of the at least one block, and the two vertical legs of the at least one anchor are spaced apart from one another a complementary distance to a thickness of the inner wall of the at least one block. Each of the at least one anchors includes two spaces, formed from space created between the inner leg and each of the outer legs, for recessing the end walls, and each of the at least one anchor includes one space, formed from space created between the two vertical legs, for recessing the inner wall of the at least one block.

Additionally provided for in the method is placing a plurality of the at least blocks end to end, combining and engaging the at least one anchor with the plurality of blocks by securing with at least one anchor, thereby securing the plurality of blocks in a multilateral direction, wherein the multilateral direction includes both X axial and Y axial directions by recessing the sidewall of the at least one block within the space between the outer leg of the at least one anchor and the inner leg of the at least one anchor, and recessing the inner wall of the at least one block within the space between the two vertical legs of the at least one anchor, administering mortar to a top surface of a block in the plurality of blocks, placing at least one block on top of a joint of two lower blocks, thereby engaging at least one of the block anchors where the walls of the block are secured between the legs of the block anchors, and securing a vertical Z axial direction with weight of a plurality of blocks on a row of blocks above.

It is an object of the current invention to provide ease of constructability with limited experience in masonry construction It is another object of the current invention to allow structures to withstand both gravity, lateral, seismic, and uplift loads due to wind It is yet further an objective of the current invention to improve the overall structural strength of masonry construction It is a further an objective to provide a system with benefits that include preventing walls from caving in or being easily penetrated with objects such as cars and heavy equipment.

It is yet a further objective to allow a user to construct the structure's sections without skilled labor.

Lastly, it is an objective of the current invention to that the masonry block anchor provides the user independence, consistency and overall quality product.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
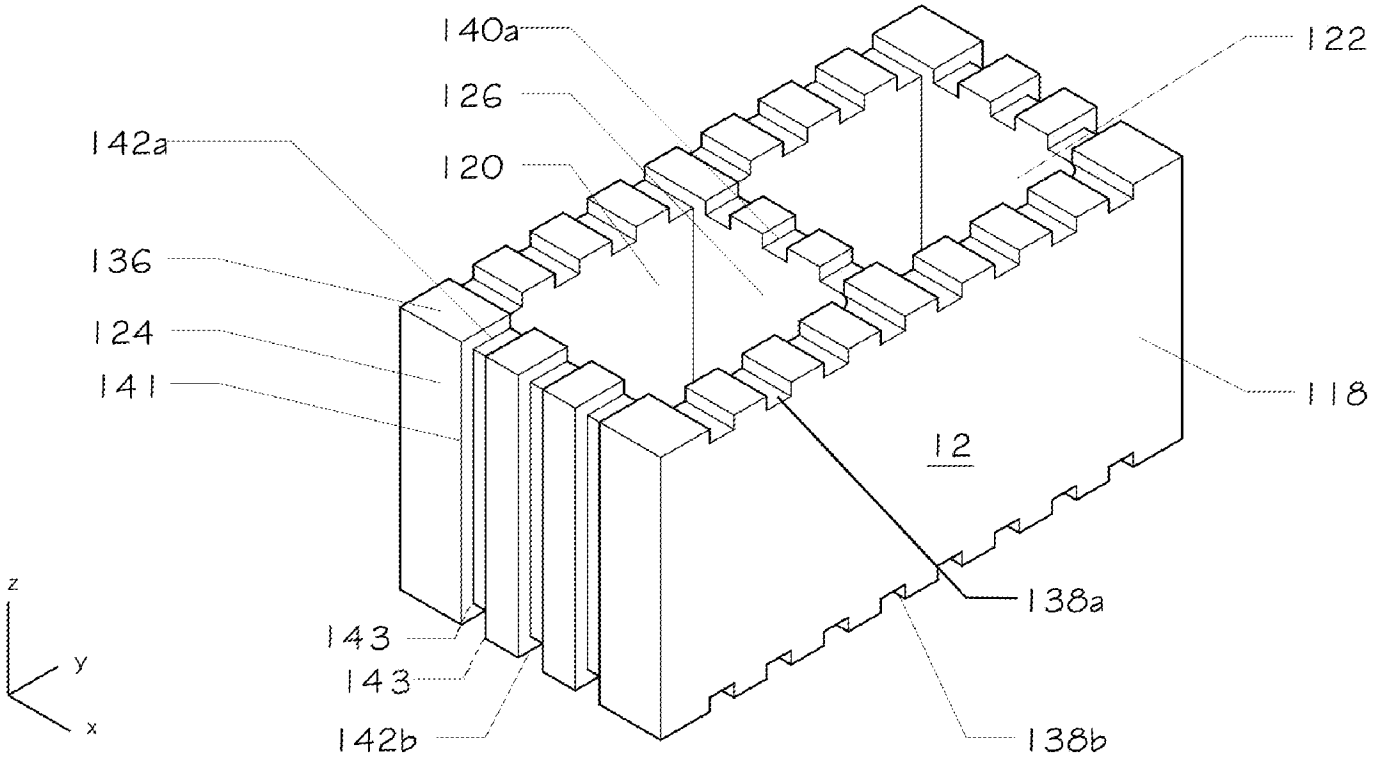
FIG. 1 is a perspective view of a block element of the system.

The present masonry block anchor system is a tool that is used in the layout of masonry construction. As mentioned, masonry is the construction of a structure by smaller units, such as masonry blocks, which are bonded together by mortar. The purpose of the masonry block anchor system is to ensure that the blocks are laid out uniformly as well as reinforcing each joint and the entire structure. The present masonry block anchor system restricts movement laterally in both the x-axial direction and y-axial direction and vertically in the z-axial direction. This system is made of non-combustible material and has x-axis, y-axis, and z-axis dimensions.

The present invention consists of three legs facing downwards in the z-axial direction with two outer legs gripping on the outer web of the two adjacent masonry blocks and the middle leg separating from one block to the other, configurable with ⅜" space between the blocks to meet standard masonry construction requirements. The blocks are to be arranged in the x, z plane and the masonry block anchor is to be placed In between them along the x-axial direction. The application in the z-axial direction differs mainly that the two top legs are to secure the center web of the upper block.

The resulting configuration would look as if there were two blocks laid out in the x-axial direction with one masonry block anchor in between them, with that same masonry block anchor in the middle of two successive blocks the system secures one block directly above it in the middle, giving the impression of a pyramid, triangular shape structure.

The masonry block anchor system has two types of applications: (1) Blocks without grooves and (2) blocks with grooves. In the system using blocks without grooves, no precut grooves will be cut into the block and the masonry block anchor will attach to the block with adhesive, such as pre-applied double-sided adhesive tape with peal cover. In the system using blocks with grooves, a precut grove will be cut into the block to allow for improved stability allowing the masonry block anchor to settle into the block and use the block itself for structural reinforcement.

The purpose of placing these masonry block anchors in between each of the masonry structures is to secure each unit and create an overall system. This system will act like a monolithic wall held together by the masonry block anchors, drawing on each unit for it's overall strength. This system's application can benefit structures to withstand both gravity, lateral, seismic, and uplift loads due to wind. Improving the overall structure's strength is the primary goal of the masonry block anchor system. Further benefits include preventing walls from caving in or being easily penetrated with objects such as cars and heavy equipment. The restriction of movement of each masonry unit allows the structure to move as one. That is, the entire block wall works together as a compound unit, rather than individual blocks with only mortar joints for lateral loads. The theory behind the system is that, the overall structure is only as strong as its weakest link. By not over-stressing the weakest link—the mortar joint between the block—the wall structure will be able to withstand in the absence of proper support (partial support) under the wall, including weaker foundations.

The secondary purpose of the masonry block anchor system is to provide ease of constructability with limited experience in masonry construction. The joint created by the masonry block anchor system meets Florida Building Code and NCMA standards (⅜"), creating a uniform joint. The uniform joint allows the user to construct a wall system that meet building code standards (such as Florida Building Code, National Concrete Masonry Association, and Portland Cement Association) and is ultimately more uniform in construction. The grout can be applied in a more uniform application and ultimately reduce any inconsistencies with traditional construction methods.

In addition to uniform construction, the masonry anchor system allows the user to construct the structure's sections without skilled labor. The uniform joint and correct alignment of the blocks allows the user to construct without the added cost of skilled labor. The masonry block anchor provides the user independence, consistency and overall quality product.

Figure 2:
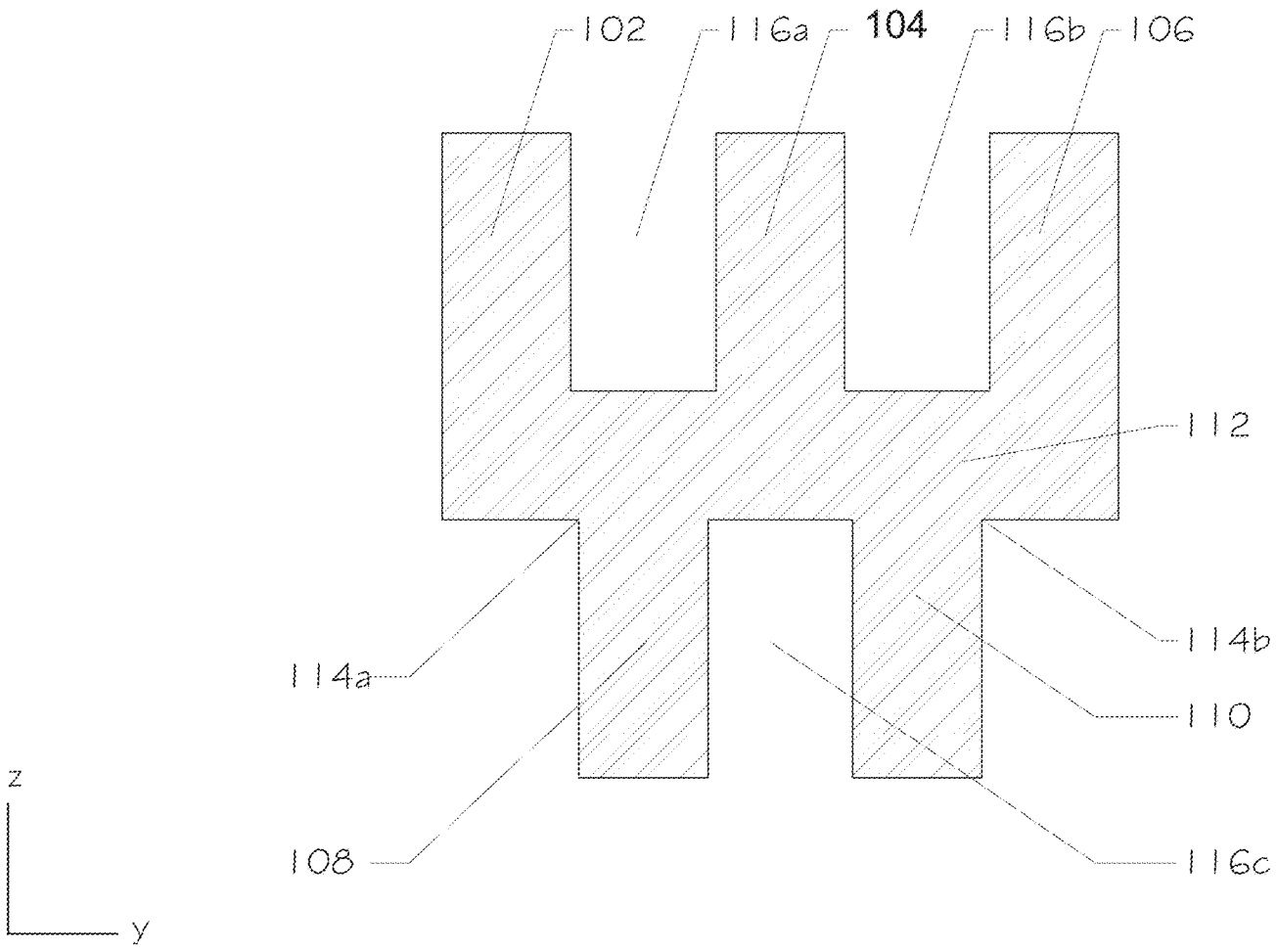
FIG. 2 is a front view of the anchor element of the system.
Figure 3:
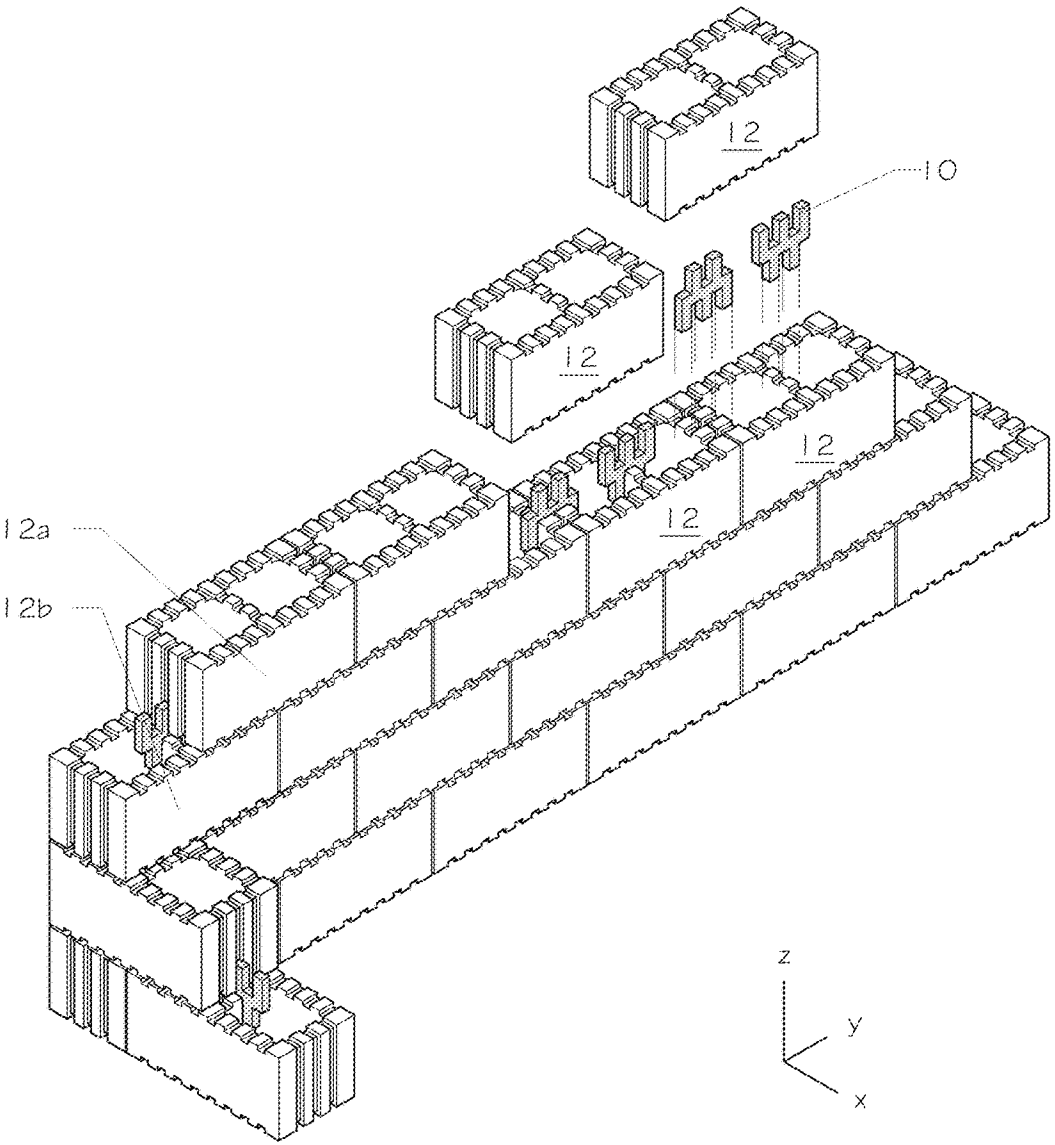
FIG. 3 is a conceptual perspective view showing the engagement of the elements of the invention.

Shown in FIG. 3 is the masonry system constructed of non-combustible material, having at least one anchor 10, shown in FIG. 2, having three vertical legs 102, 104, and 106, attached to a central horizontal member 112, and two vertical legs 108 and 110 attached to the central horizontal member 112 extending in an opposite direction from the three vertical legs 102, 104, and 106, wherein the three vertical legs include a central leg 104 and two outer legs 102 and 106, wherein two vertical legs meet the central horizontal member at a connection point 114*a*/114*b* opposite of a spacing 116*a* 116*b* between the three vertical legs 102, 104, and 106.

Figure 7:
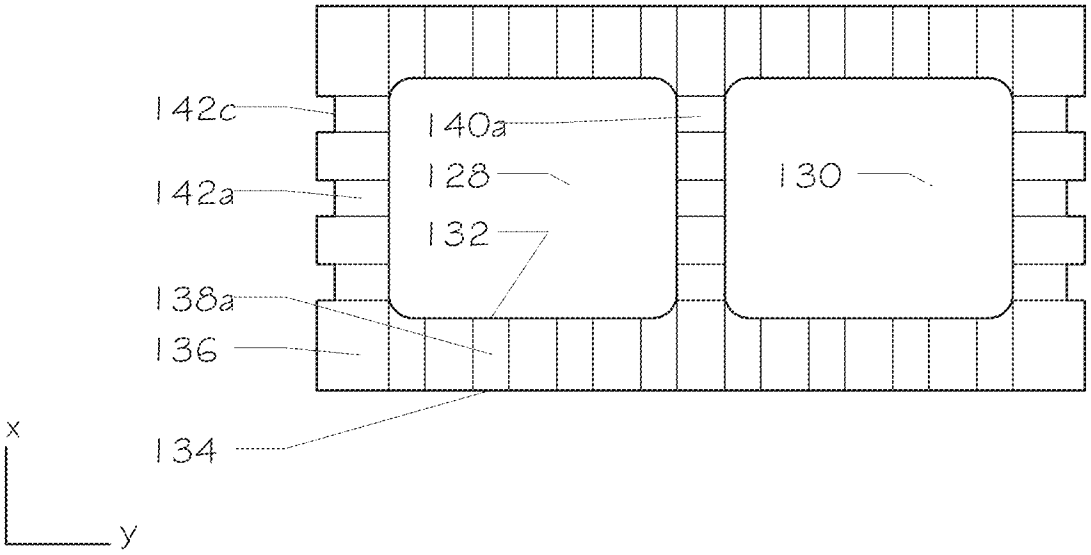
FIG. 7 is a top view of the block element of the first embodiment of the system.

Shown in FIG. 1 is at least one block 12 having four outer walls 118, 120, 122, and 124, and one inner wall 126 defining two internal vertical cavities 128 and 130, as shown more particularly in FIG. 7, wherein the four outer walls include two sidewalls 118 and 120 connected by two end walls 122 and 124, and the inner wall 126 connecting to the two sidewalls 118 and 120. Also shown in FIG. 1 are the "C"-shaped anchor groove channel 141 and the anchor groove sidewalls 143.

Figure 8:
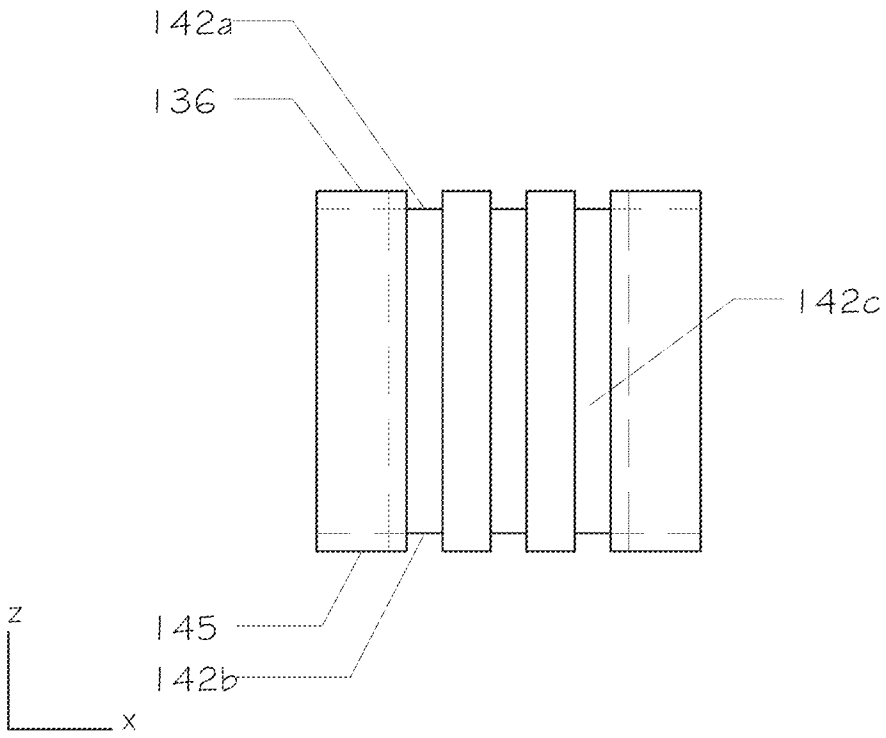
FIG. 8 is an end view of the block element of the first embodiment of the system.

Shown in FIGS. 1, 7, and 8, the block may further includes grooves 138*a* and 142*a* cut in to an upper surface 136 and grooves 138*b*/142*b* cut in to a lower surfaces, wherein the grooves begin at an inner surface 132 of a vertical cavity of the two vertical cavities and extend to an outer surface 134 of a wall of the four outer walls. Grooves 140*a* may also exist, wherein the grooves begin at an inner surface of a vertical cavity of the two vertical cavities and extend to the second internal cavity of the two vertical cavities, as shown in FIGS. 1 and 7.

Figure 4:
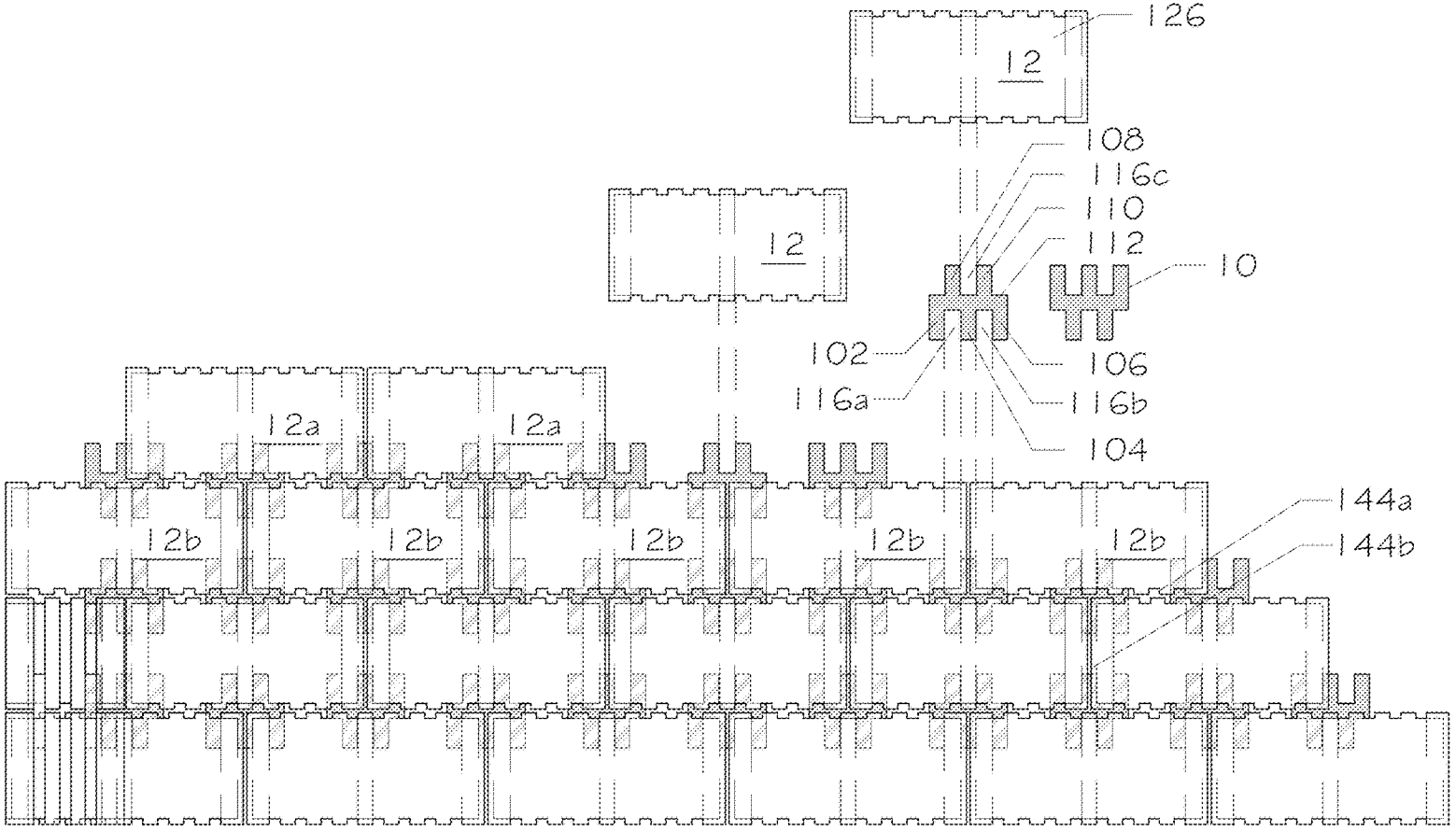
FIG. 4 is a schematic view showing the engagement of the elements of the invention.

The grooves 142*a*/142*b*, 138*a*/138*b*, or 140*a* are defined by a thickness of the central horizontal member 112 of the at least one anchor 10, to allow for a complemental fit of the central horizontal member 112 of the at least one anchor within the groove 142*a*/142*b*, 138*a*/138*b*, or 140*a*, of the at least one block 12, which may be seen by viewing the anchor 10 shown in FIGS. 2, 3, and 4 and the block 12 in FIGS. 1, 3, and 4.

Figure 9:
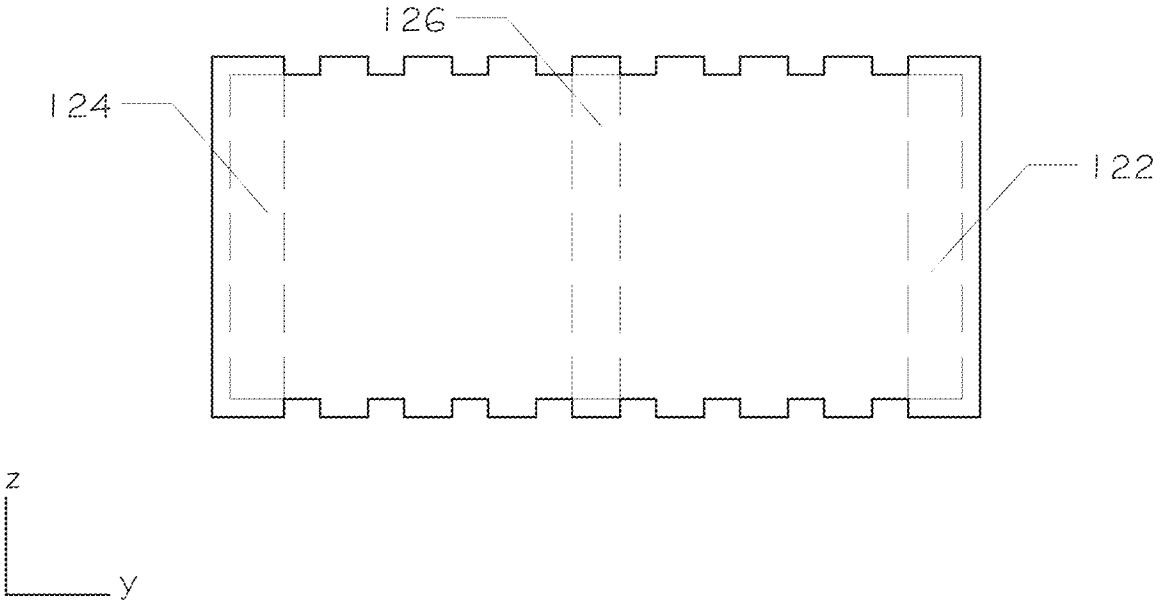
FIG. 9 is a front view of the block element of the first embodiment of the system.

FIG. 4 shows three vertical legs 102, 104, and 106 of the at least one anchor 10 are spaced apart from one another a complementary distance to a thickness of the end walls 122/124 of the at least one block 12, and two vertical legs 108 and 110 of the at least one anchor are spaced apart from one another a complementary distance to a thickness of the inner wall 126 of the at least one block 12. Each of the at least one anchors 10 includes two spaces 116*a*/116*b*, formed from space created between the inner leg 104 and each of the outer legs 102/106, for recessing the end walls 122/124, and each of the at least one anchor 10 includes one space 116*c*, formed from space created between the two vertical legs 108 and 110, for recessing the inner wall 126 of the at least one block 12. FIG. 9 further shows a schematic view of the layout of the block 12 from a front view. As noticed, the end walls 122/124 are shown, wherein the boundaries of the wall are indicated in dashed lines, as is a inner wall 126.

A thickness of the three vertical legs 102, 104, and 106, the two vertical legs 108 and 110, and the central horizontal member 112, are configured for spacing standards between blocks in masonry construction.

Figure 5:
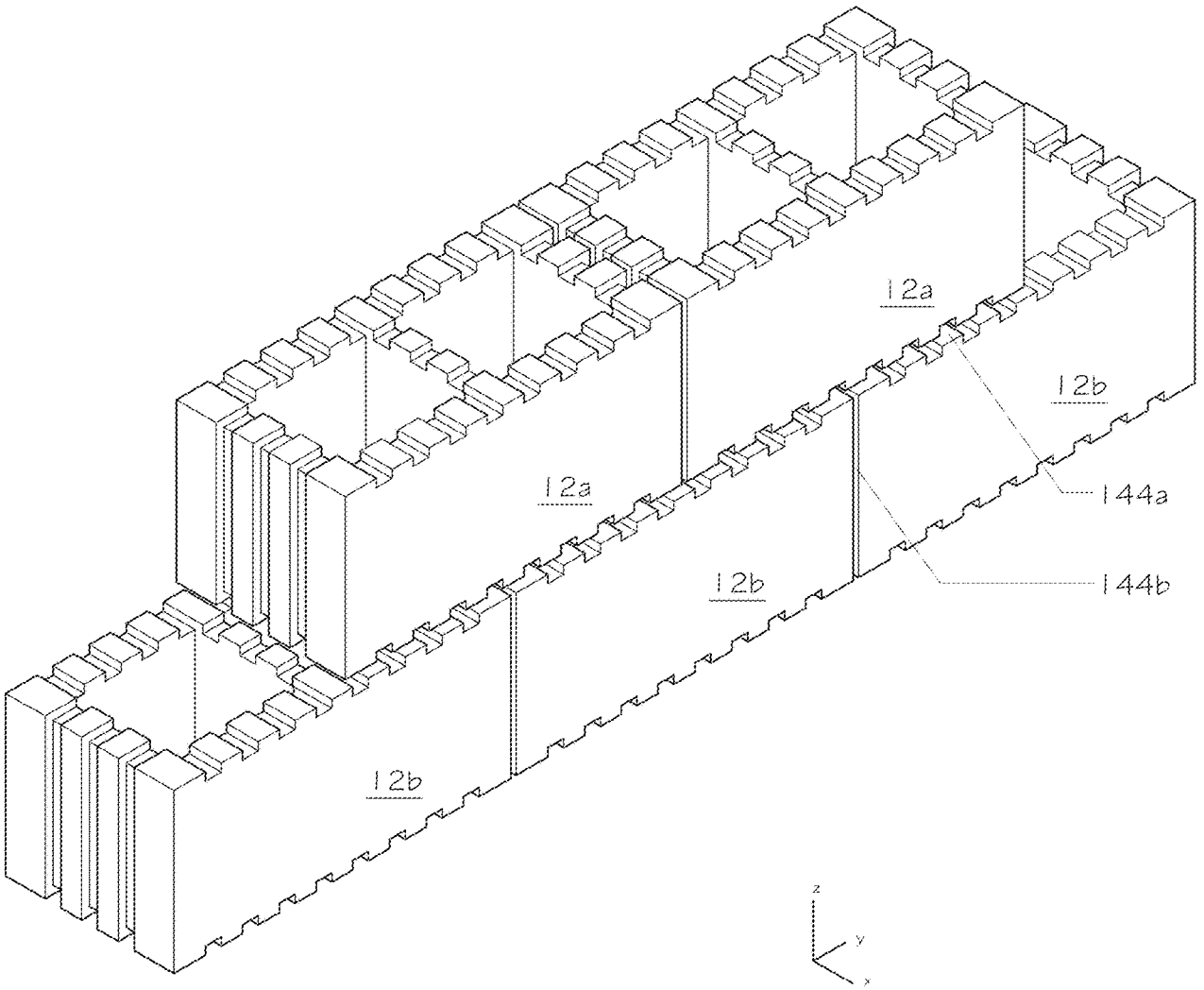
FIG. 5 is a perspective view of a first embodiment of the system.

FIGS. 3, 4, and 5 show the at least one block 12 as a plurality of blocks with at least one upper block 12*a* and at least one lower block 12*b*. The blocks 12*a*/12*b* are in a staggered by a configuration, known as a running bond, of the spacing 116*a*/116*b* between the three vertical legs 102/104/106 of the at least one anchor 10 and spacing 116*c* between the two vertical legs 108/110 of the at least one anchor 10, wherein the staggering of the spacing provides for staggering of the at least one upper block 12*a* and at least one lower block 12*b*.

FIGS. 3 and 4 show a combination and engagement of the at least one anchor 10 with the plurality of blocks 12, wherein the combination and engagement provides for spacing and anchoring of the plurality of blocks 12 when the plurality of blocks 12 are placed end to end and secured with at least one anchor 10. The combination and engagement of the at least one anchor 10 with the plurality of blocks 12 further includes recession of the sidewall 122/124 of the at least one block 12 within the space 116*a*/116*b* between the outer leg 102/106 of the at least one anchor 10 and the inner leg 104 of the at least one anchor 10, as shown in FIG. 4. Fig. FIG. 4 shows the recession of the inner wall 126 of the at least one block 12 within the space 116*c* between the two vertical legs 108 and 110 of the at least one anchor 10.

As noticed in FIG. 3, the at least one anchor 10 secures the plurality of blocks 12 in a multilateral direction, wherein the multilateral direction includes both X axial and Y axial directions, and a vertical Z axial direction is secured from weight of a plurality of blocks 12*b* on a row of blocks 12*a* above, as shown in FIGS. 4 and 5.

Figure 25:
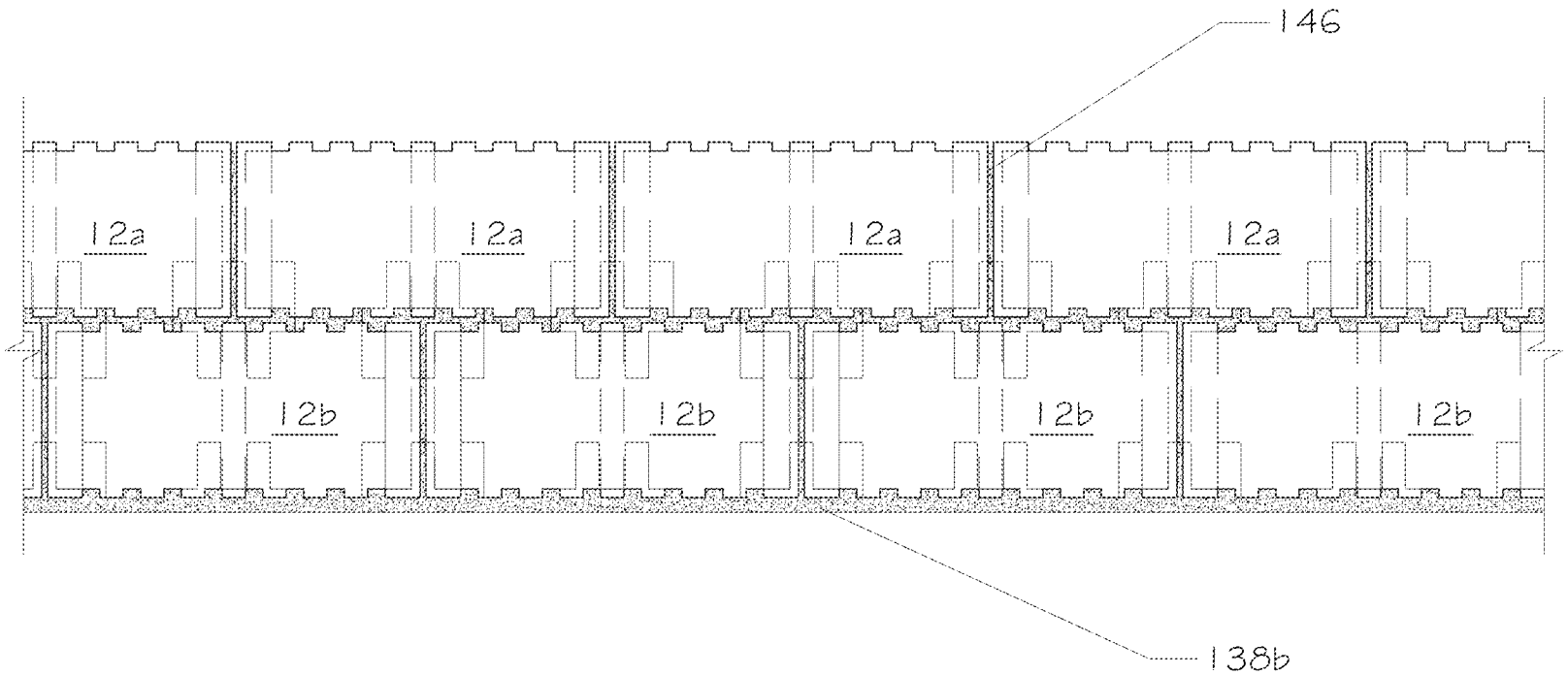
FIG. 25 is a front view of a plurality of blocks of the system with mortar applied.

The combination and engagement of the at least one anchor 10 with the plurality of blocks 12 provides the at least one upper block 12*a* and the at least one lower block 12*b* with interlocking anchoring, as shown in FIGS. 3, 4, and 5, allowing a configurable distance 144*a*/144*b* for lateral spacing 144*a* and vertical spacing 144*b* above, below, and between all blocks 12 within the plurality of blocks that provides for a standard and uniform spacing. The most common configurable distance should be about a ⅜" space between each block 12 in the plurality of blocks to meet standard masonry construction requirements. Mortar 146 is included within this spacing above, below, and between all blocks within the plurality of blocks, as shown in FIG. 25.

The present invention provides for a method of using the 2-part masonry block anchor system in masonry construction is shown primarily in FIGS. 1, 2, 3, 4, and 7, and includes providing at least one block 12 having four outer walls 118, 120, 122, and 124, and one inner wall 126 defining two internal vertical cavities 128 and 130, wherein the four outer walls comprise two sidewalls 118 and 120 connected by two end walls 124 and 122, the inner wall 126 connecting to the two sidewalls 118 and 120.

The method further includes providing at least one anchor 10 having three vertical legs 102, 104, and 106 attached to a central horizontal member 112, and two vertical legs 108 and 110 attached to the central horizontal member 112 extending in an opposite direction from the three vertical legs 102, 104, and 106, wherein the three vertical legs include a central leg 104 and two outer legs 102 and 106, and the two vertical legs 108 and 110 meet the central horizontal member 112 at a connection point 114*a* and 114*b* opposite of a spacing 116*a* and 116*b* between the three vertical legs 102, 104, and 106, as shown in FIG. 2. The three vertical legs 102, 104, and 106 of the at least one anchor 10 are spaced apart from one another a complementary distance to a thickness of the end walls 122 and 124 of the at least one block 12, and the two vertical legs 108 and 110 of the at least one anchor 10 are spaced apart from one another a complementary distance to a thickness of the inner wall 126 of the at least one block. Each of the at least one anchors includes two spaces 116*a* and 116*b*, formed from space created between the inner leg 104 and each of the outer legs 102 and 106, for recessing the end walls 122 and 124, and each of the at least one anchor 10 includes one space 116*c*, formed from space created between the two vertical legs 108 and 110, for recessing the inner wall 126 of the at least one block 12.

After providing the blocks 12 and anchors 10, the method further includes placing a plurality of the at least blocks end to end, combining and engaging the at least one anchor 10 with the plurality of blocks 12 by securing with at least one anchor 10, thereby securing the plurality of blocks 12 in a multilateral direction, wherein the multilateral direction includes both X axial and Y axial directions by recessing the sidewall 122 and 124 of the at least one block 12 within the space 116*a* and 116*b* between the outer leg 102 and 106 of the at least one anchor 10 and the inner leg 104 of the at least one anchor 10, and recessing the inner wall 126 of the at least one block 12 within the space 116*c* between the two vertical legs 108 and 110 of the at least one anchor 10, administering mortar to a top surface 136 of a block 12 in the plurality of blocks, placing at least one block 12 on top of a joint of two lower blocks 12, thereby engaging at least one of the block anchors 10 where the walls 122, 124, and 126 of the block 12 are secured between the legs 102, 104, 106, 108, and 110 of the block anchors 10, and securing a vertical Z axial direction with weight of a plurality of blocks on a row of blocks above.

It is important to provide uniform spacing. As such, the method includes providing uniform spacing between said least one upper block 12*a* and said at least one lower block 12*b*. This may further include applying mortar within spacing above 144*a*, below 144*a*, and between 144*b* all blocks 12*a/b* within said plurality of blocks. Another important aspect of the method is configuring a thickness of said three vertical legs 102, 104, and 106, said two vertical legs 108 and 110, and said central horizontal member 112, for spacing standards between blocks in masonry construction. By configuring the thickness, the anchors 10 can provide a uniform spacing between blocks 12, which can be a challenge of prior masonry construction when the only spacing is achieved by the amount of mortar between blocks.

Another important aspect for achieving proper securement is including grooves 142*a*, 142*b*, 142*c*, 138*a*, 138*b*, 140*a*, and 140*b* in the blocks 12. The method includes cutting grooves 142*a*, 142*b*, 138*a*, 138*b*, 140*a*, and 140*b* in to upper 136 and lower 145 surfaces. Grooves 138*a*/138*b* can be along the outer walls 118/120, wherein said grooves begin at an inner surface 132 of a vertical cavity 128/130 of said two vertical cavities 128 and 130 and extend to an outer surface 130 of a wall 118/120 of said four outer walls, or inner walls 126 wherein grooves begin at an inner surface 132 of a vertical cavity 128/130 of said two vertical cavities 128 and 130 and extend to the second internal cavity 128/130 of said two vertical cavities 128 and 130. This allows for a complemental fit of said central horizontal member 112 of said at least one anchor 10 within said groove 142*a*, 142*b*, 140*a*, and 140*b* of said block 12, and defines a thickness of said grooves 142*a*, 142*b*, 140*a*, and 140*b* to be comparable to that of at least one anchor's central horizontal member 112.

As may be appreciated from FIGS. 6, 11, 16, and 21, grooves may be cut in a variety of different orientations that extend from the inner cavity to the outer wall surface. FIGS. 6, 11, 16, and 21 show a transparent view of different arrangements of the block, allowing a view of all the walls and surfaces. As discussed, grooves provide for enhanced securement of the blocks when mortar is placed within the spaces between the blocks, because the grooves act as a secondary anchor for the system. Therefore, groove orientation may be selected for desired areas of further structural support.

FIGS. 5, 6, 7, 8, and 9 show one orientation of grooves. On the horizontal surface 136 of the block 12 exist grooves 138*a*, 140*a*, and 142*a*. The bottom surface contains a mirror of the grooves on the top surface 136. In the end wall 124 exists grooves 142*c*. As such, end wall 122 will also have a mirror of the groves in wall 124. There are no vertical grooves cut in to sidewalls 118 or 120. The groove 142*c* in sidewall 124 connects grooves 142*a* on the upper surface 136 and 142*b* on the lower surface 145.

Figure 6:
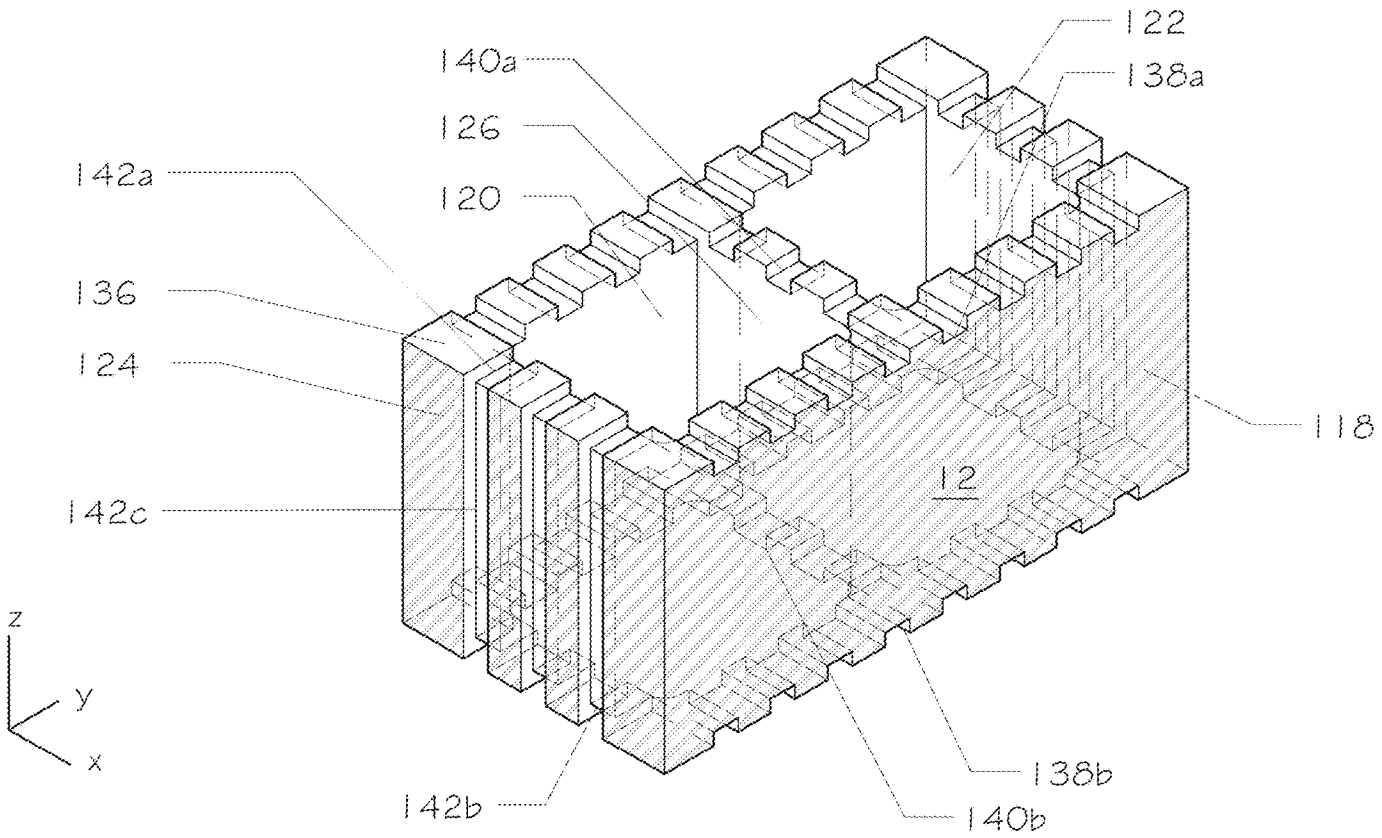
FIG. 6 is a perspective view of the block element of the first embodiment of the system.

FIGS. 10, 11, 12, 13, and 14 show another orientation of grooves. The primary difference between this orientation and the previous block shown in FIG. 6, is that this block contains horizontal grooves on the horizontal surfaces, but no vertical grooves. On the top surface 236 of the block 22 exist grooves 238*a*, 240*a*, and 242*a*. The bottom surface contains a mirror of the grooves on the top surface 236. In the end wall 224 no vertical grooves exist. As such, end wall 222 will also have a mirror of the groves in wall 224. There are no vertical grooves cut in to sidewalls 218 or 220. Also shown in the FIGS. 10, 11, 12, 13, and 14 are the lower groove 240*b* in the inner wall, lower groove 238*b* in the sidewall, lower groove 242*b* in the end wall, inner wall 226, vertical cavities 228 and 230, lower surface 245, inner surface 232, and outer surface 234.

Figure 10:
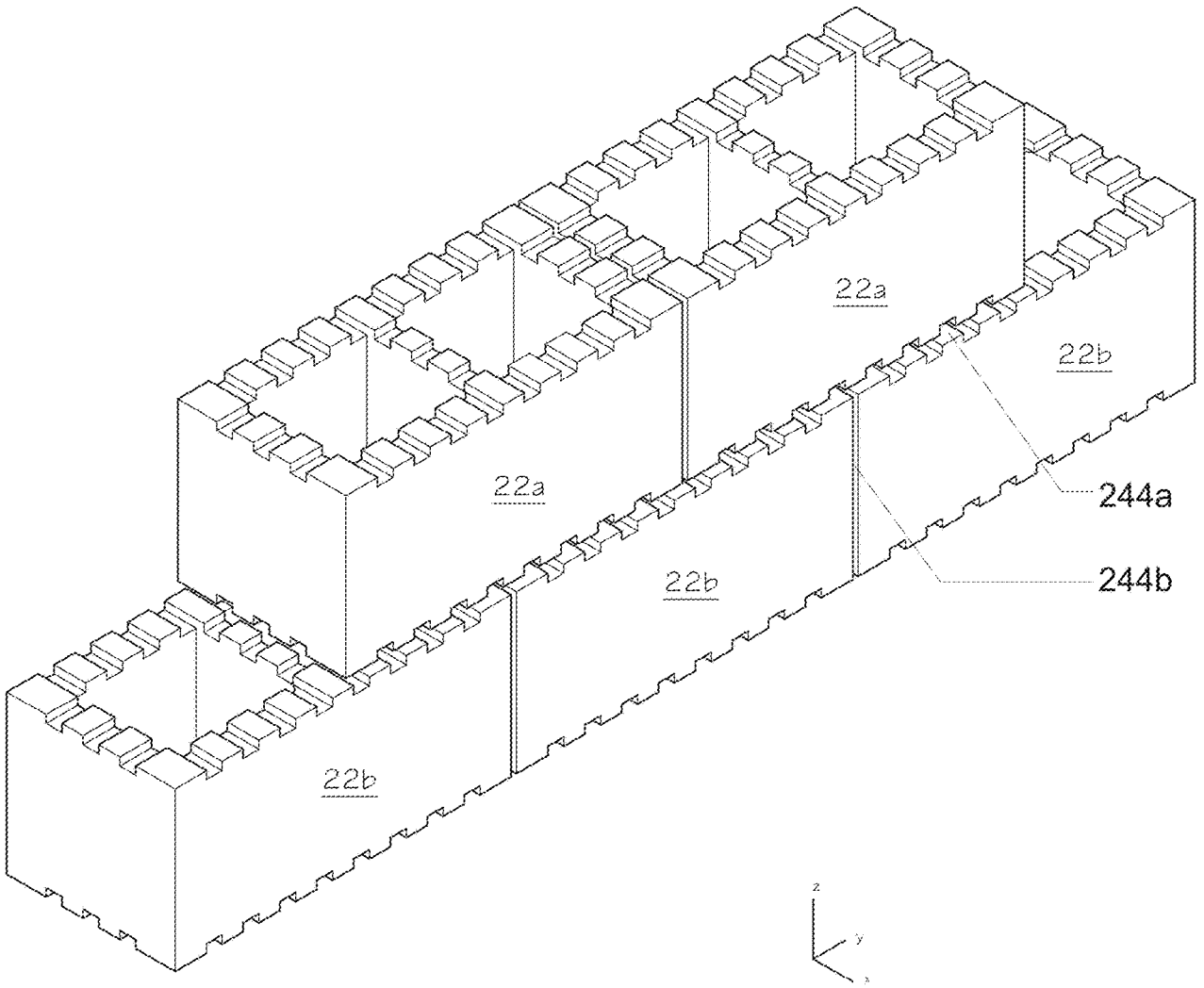
FIG. 10 is a perspective view of a second embodiment of the system.
Figure 11:
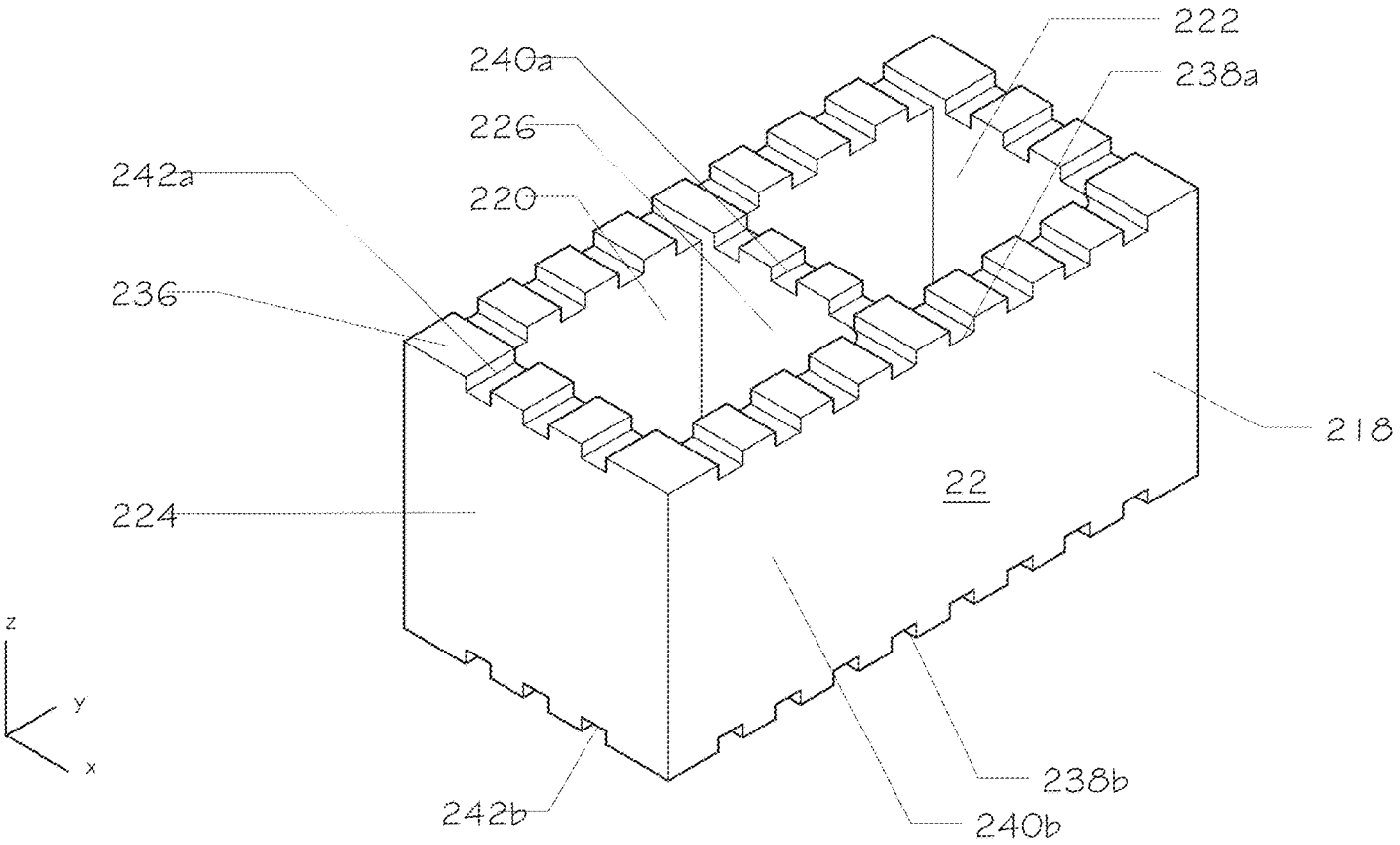
FIG. 11 is a perspective view of the block element of the second embodiment of the system.
Figure 12:
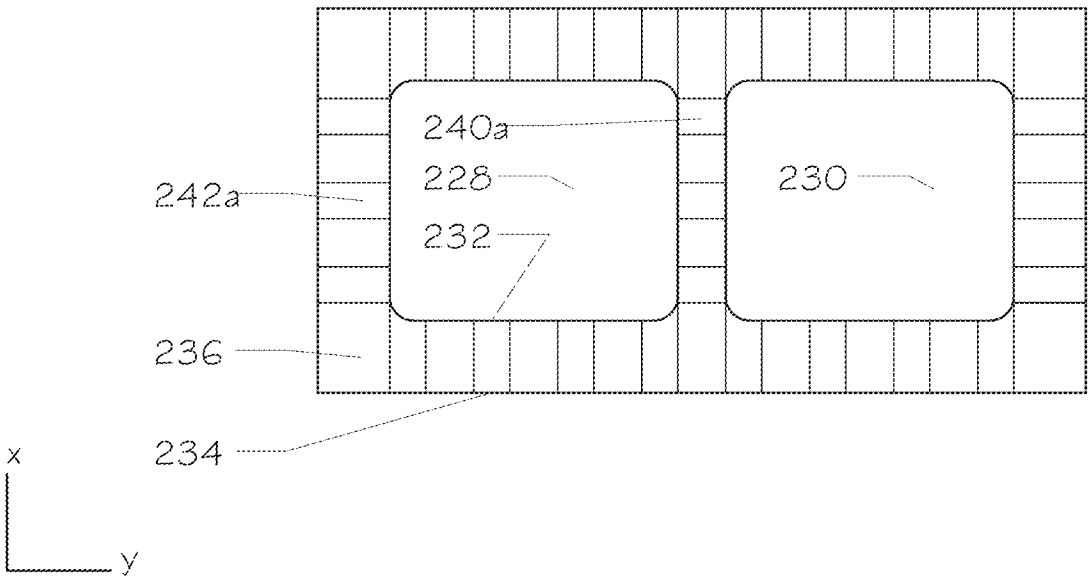
FIG. 12 is a top view of the block element of the second embodiment of the system.
Figure 13:
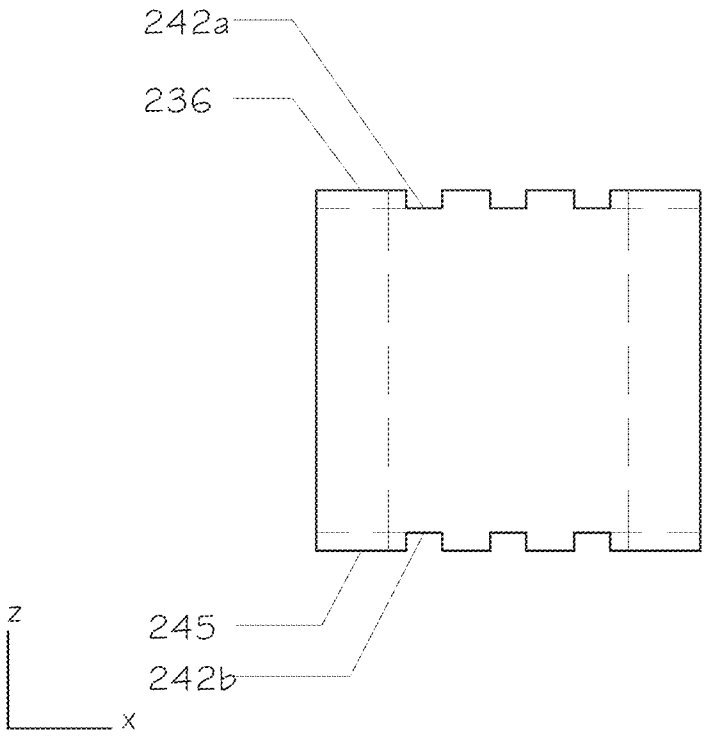
FIG. 13 is an end view of the block element of the second embodiment of the system.
Figure 14:
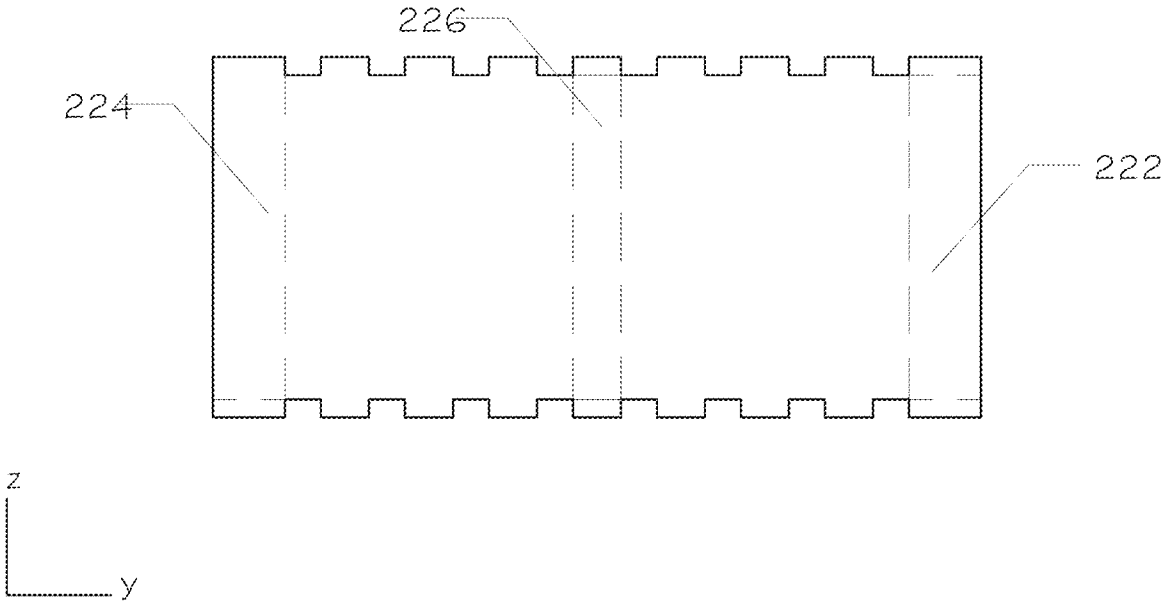
FIG. 14 is a front view of the block element of the second embodiment of the system.

FIG. 10 also shows at least one upper block 22*a* and the at least one lower block 22*b* and the configurable distance 244*a*/244*b* for lateral spacing 244*a* and vertical spacing 244*b* above, below, and between all blocks.

FIGS. 15, 16, 17, 18, and 19 show a further orientation of grooves. The primary difference between this orientation and the prior block shown in FIG. 6, is that this block contains horizontal grooves on the horizontal surface of the side walls and vertical grooves on the end walls, but no horizontal grooves on the end walls. On the top surface 336 of the block 32 exist grooves 338*a*. The bottom surface contains a mirror of the grooves on the top surface 336. In the end wall 324 vertical grooves 342*c* exist. As such, end wall 322 will also have a mirror of the groves in wall 324. There are no vertical grooves cut in to sidewalls 318 or 320. Also shown in the FIGS. 15, 16, 17, 18, and 19 are the lower groove 338*b* in the sidewall, inner wall 326, vertical cavities 328 and 330, lower surface 345, inner surface 332, and outer surface 334.

Figure 15:
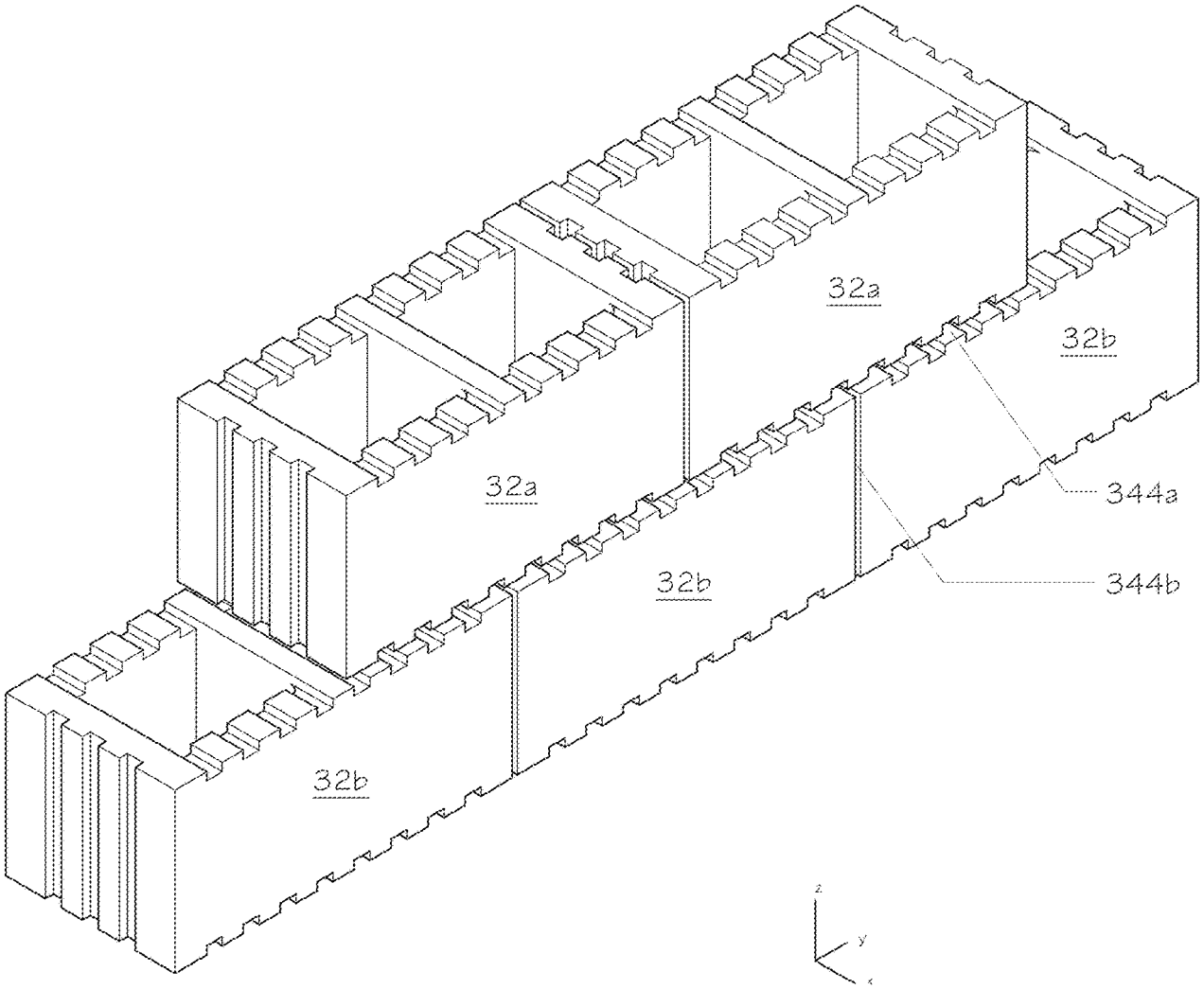
FIG. 15 is a perspective view of a third embodiment of the system.
Figure 16:
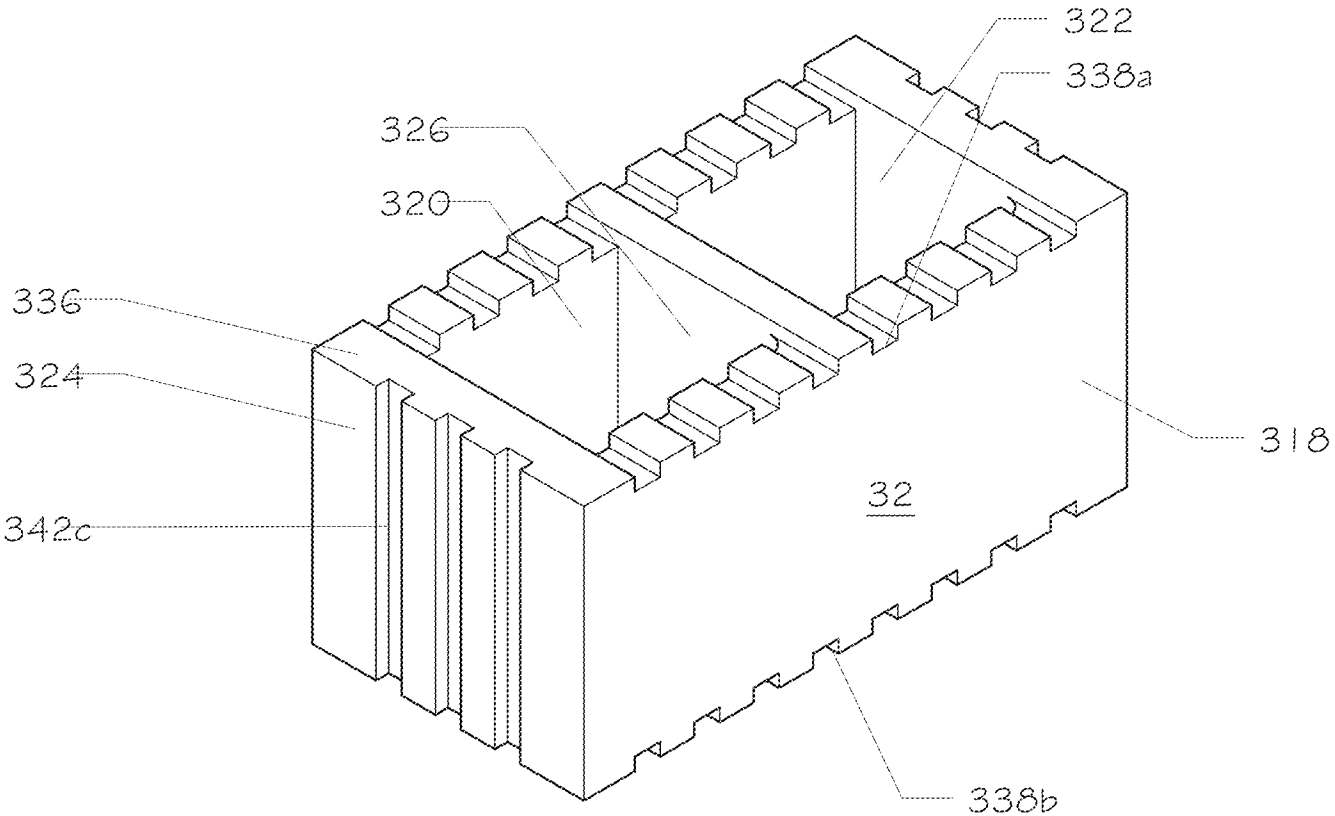
FIG. 16 is a perspective view of the block element of the third embodiment of the system.
Figure 17:
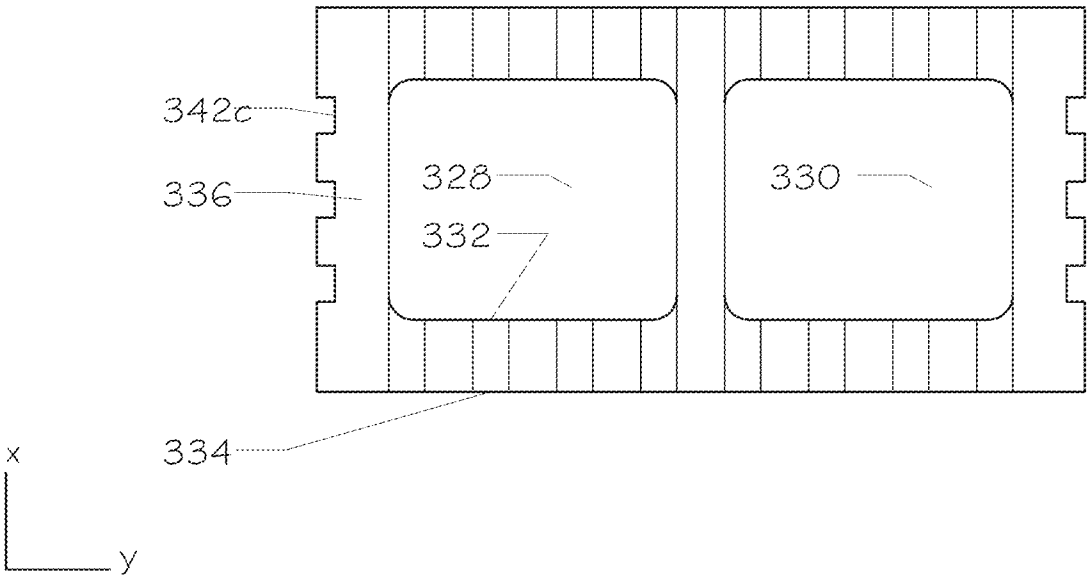
FIG. 17 is a top view of the block element of the third embodiment of the system.
Figure 18:
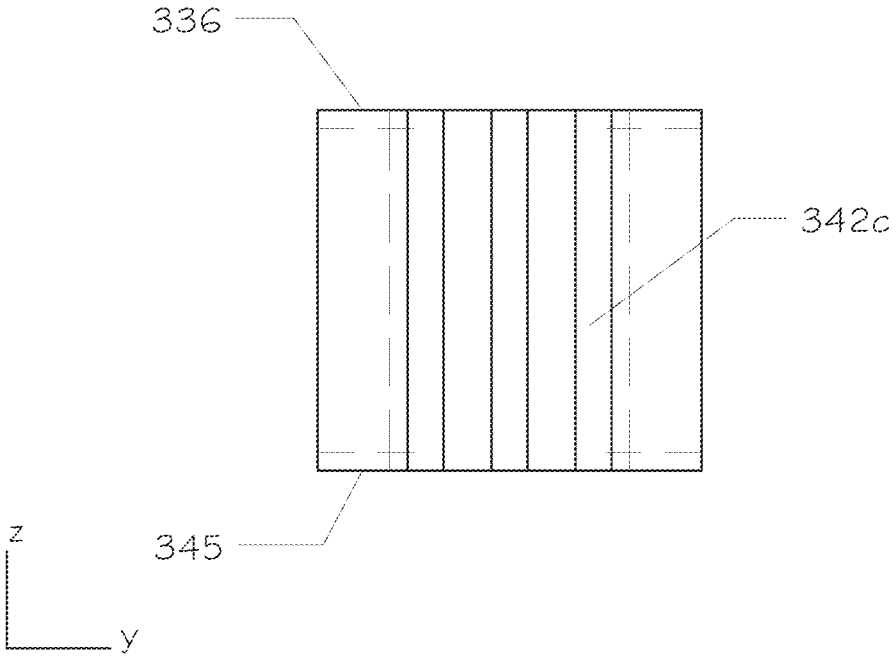
FIG. 18 is an end view of the block element of the third embodiment of the system.
Figure 19:
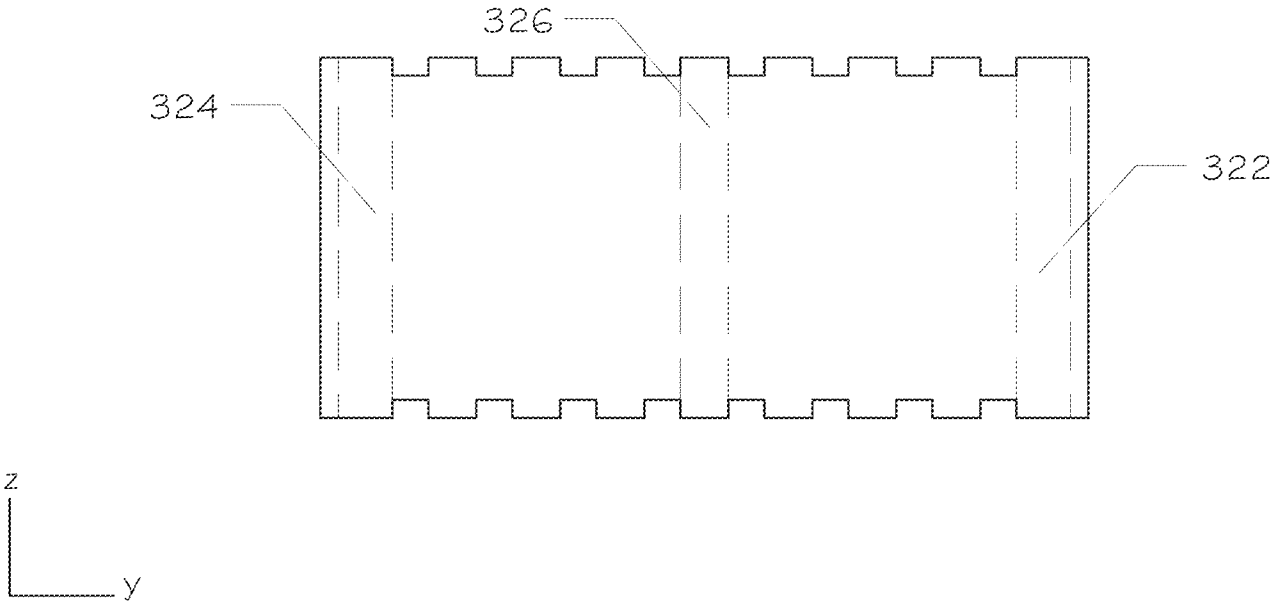
FIG. 19 is a front view of the block element of the third embodiment of the system.

FIG. 15 also shows at least one upper block 32*a* and the at least one lower block 32*b* and the configurable distance 344*a*/344*b* for lateral spacing 344*a* and vertical spacing 344*b* above, below, and between all blocks.

FIGS. 20, 21, 22, 23, and 24 show an additional orientation of grooves. The primary difference between this orientation and the prior block shown in FIG. 6, is that this block contains horizontal diagonal grooves on the horizontal surface of the side walls and end walls but no vertical grooves on the end walls. On the top surface 436 of the block 42 exist grooves 442*a* and 438*a*. The bottom surface contains a mirror of the grooves on the top surface 436, including lower groove 442*b*. In the end wall 424, no vertical grooves exist. As such, end wall 422 will also have no grooves. There are no vertical grooves cut in to sidewalls 418 or 420. Inner wall 426 will have grooves 440*a* and lower groves 440*b*. Also shown in the FIGS. 20, 21, 22, 23, and 24 are the lower groove 438*b* in the sidewall, inner wall 426, vertical cavities 428 and 430, lower surface 445, inner surface 432, and outer surface 434.

Figure 20:
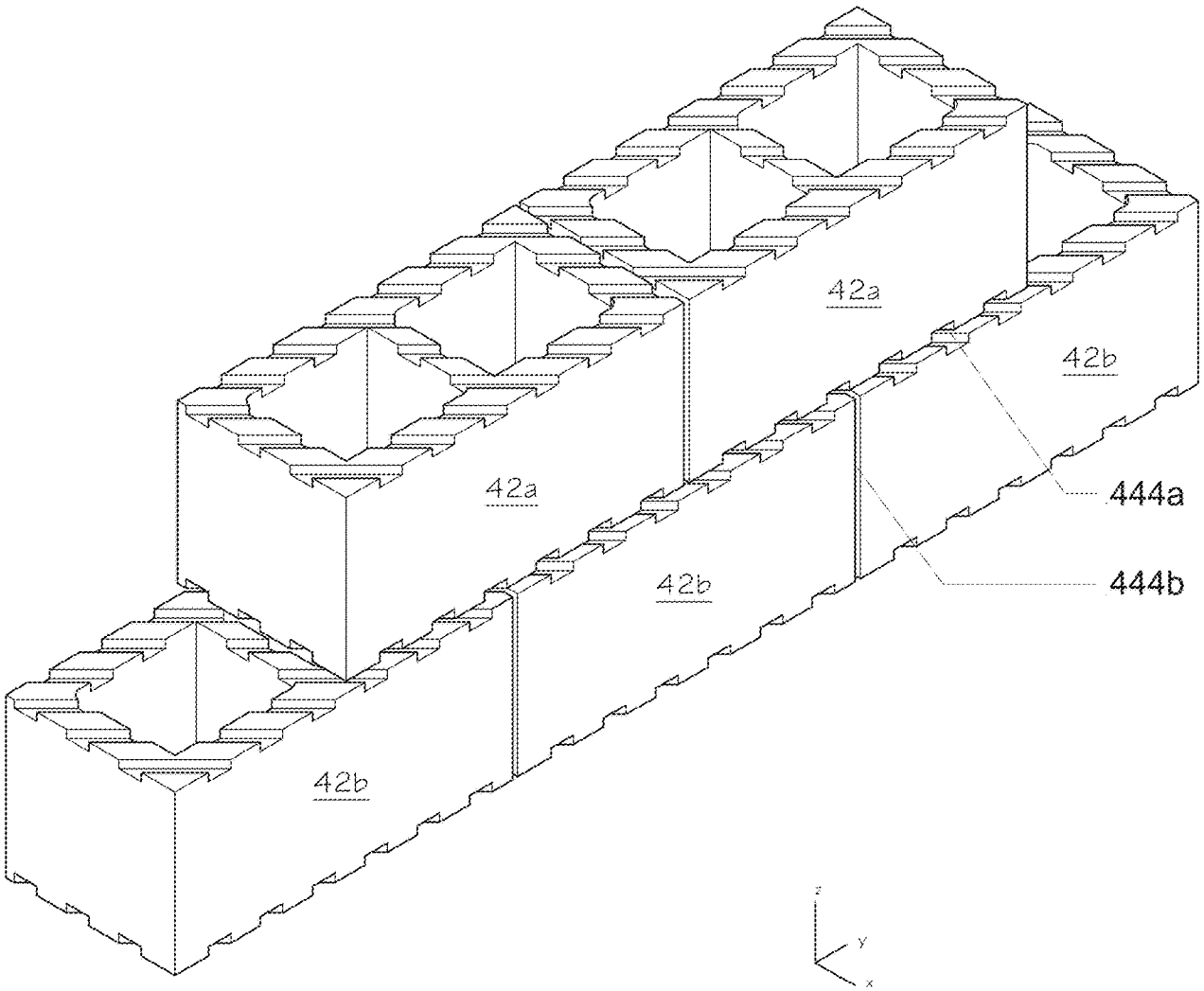
FIG. 20 is a perspective view of a fourth embodiment of the system
Figure 21:
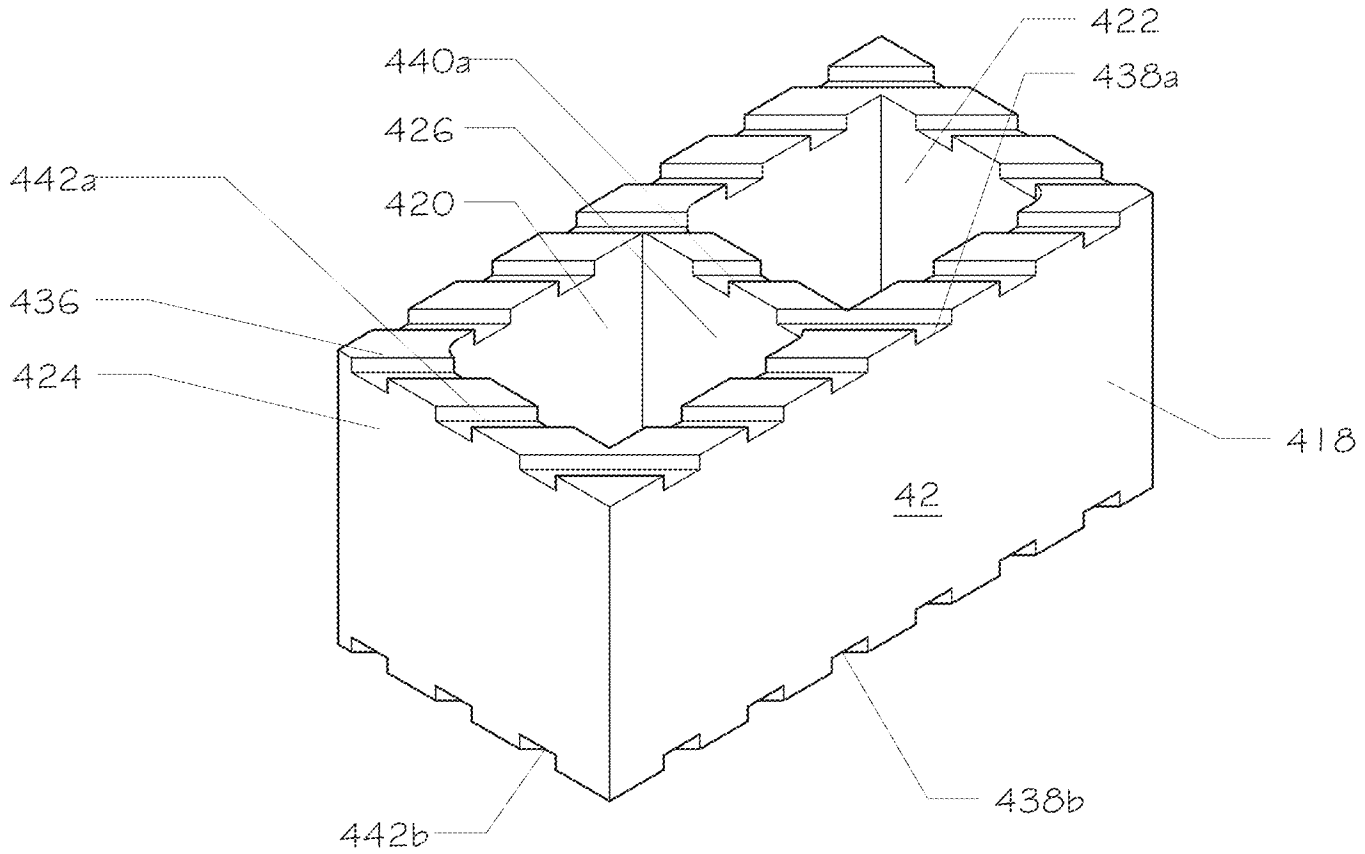
FIG. 21 is a perspective view of the block element of the fourth embodiment of the system.
Figure 22:
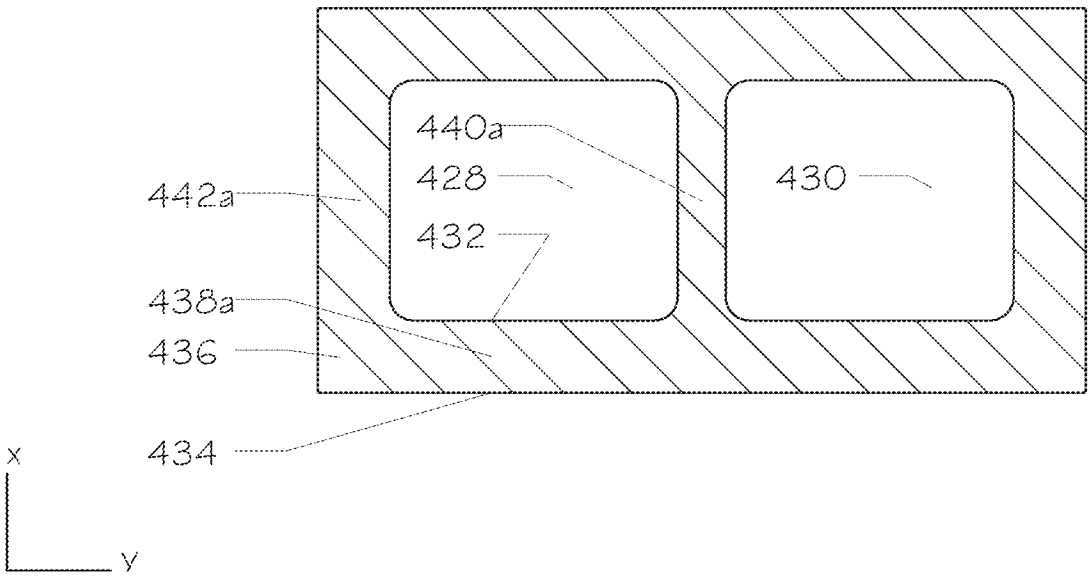
FIG. 22 is a top view of the block element of the fourth embodiment of the system.
Figure 23:
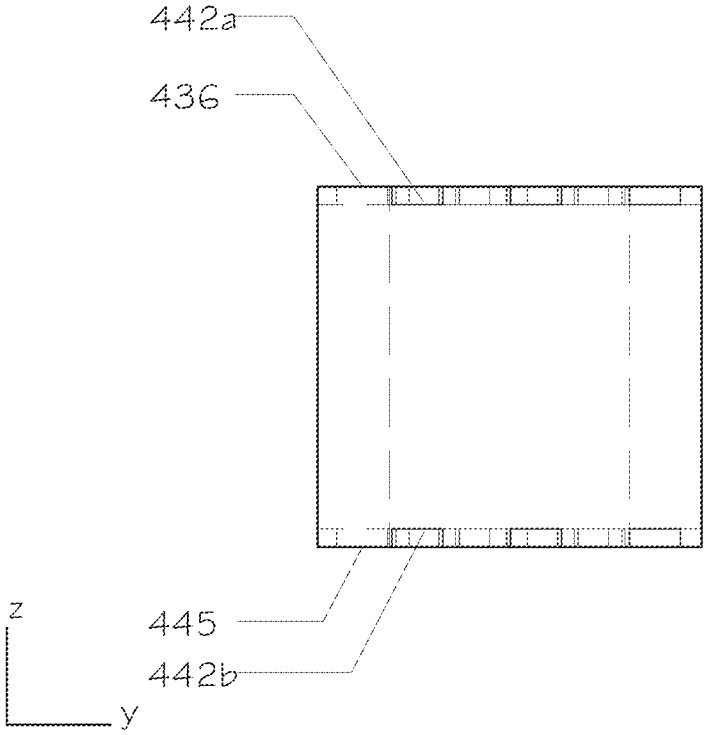
FIG. 23 is an end view of the block element of the fourth embodiment of the system.
Figure 24:
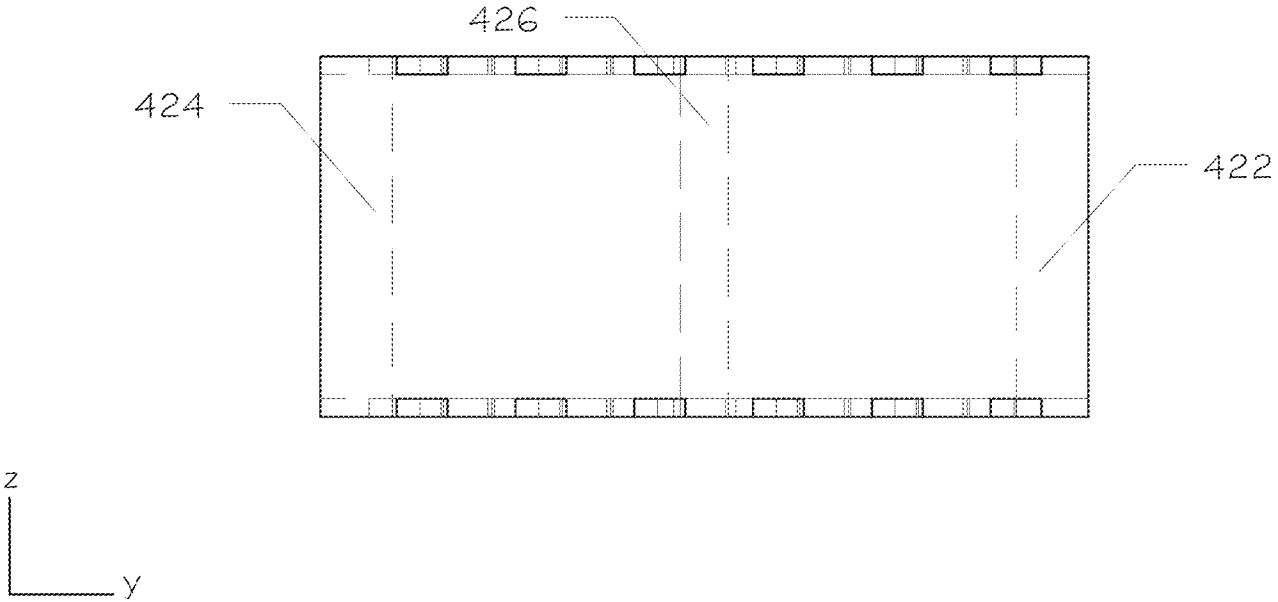
FIG. 24 is a front view of the block element of the fourth embodiment of the system.

FIG. 20 also shows at least one upper block 42*a* and the at least one lower block 42*b* and the configurable distance 444*a*/444*b* for lateral spacing 444*a* and vertical spacing 444*b* above, below, and between all blocks.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A masonry system constructed of non-combustible material, comprising:

at least two anchors each having three vertical legs attached to a central horizontal member, and two vertical legs attached to said central horizontal member extending in an opposite direction from said three vertical legs, wherein said three vertical legs include a central leg and two outer legs;

said two vertical legs meet said central horizontal member at a connection point opposite of a spacing between said three vertical legs;

at least two blocks each having four outer walls and one inner wall defining two internal vertical cavities, wherein said four outer walls include two sidewalls connected by two end walls and said inner wall connecting to said two sidewalls;

each block in said at least two blocks having at least two anchor grooves per end wall, wherein each anchor groove in said at least two anchor grooves per end wall is recessed within said end walls of said block, wherein said anchor grooves recess down from an upper surface, up from a lower surface, and in from an outer surface, thereby defining a C-shaped channel per anchor groove bordered by two anchor side walls;

each block further includes grooves cut into an upper surface of said sidewall and grooves cut into lower surfaces of said sidewall, wherein said grooves begin at an inner surface of a respective vertical cavity of said two vertical cavities and extend to an outer surface of said sidewall;

said three vertical legs of each of said at least two anchors are spaced apart from one another a complementary distance to a thickness of said end walls of each of said at least two blocks;

said two vertical legs of each of said at least two anchors are spaced apart from one another a complementary distance to a thickness of said inner wall of each of said at least two blocks;

each of the at least two anchors includes two spaces, formed from space created between said inner leg and each of said outer legs, for recessing said end walls; and each of each of the at least two anchors includes one space, formed from space created between said two vertical legs, for recessing said inner wall of each of said at least two blocks.

2. The masonry system as recited in claim 1, wherein a thickness of said three vertical legs, said two vertical legs, and said central horizontal member, are configured for insertion into a complemental anchor groove in said at least two anchor grooves; and each anchor groove in said at least two anchor grooves is configured for a depth of approximately one-third of the thicknesses of each of said three vertical legs, said two vertical legs, and said central horizontal member.

3. The masonry system as recited in claim 2, further comprising:

said at least two blocks include a plurality of blocks with at least one upper block and at least one lower block; and a staggered configuration of said spacing between said three vertical legs of each anchor in said at least two anchors and spacing between said two vertical legs of each of said at anchors, wherein said staggering of said spacing provides for staggering of said at least one upper block and at least one lower block.

4. The masonry system as recited in claim 3, further comprising:

a combination and engagement of each anchor in said at least two anchors with said plurality of blocks, wherein said combination and engagement provides for spacing and anchoring of said plurality of blocks when said plurality of blocks are placed end to end and secured with at least one anchor;

said combination and engagement of said at least one anchor with said plurality of blocks further includes recession of said end wall of each block, in said at least two blocks within said space between the outer leg of said at least one anchor and said inner leg of said at least one anchor;

said combination and engagement of said at least one anchor with said plurality of blocks further includes recession of said inner wall of said at least one block within said space between the two vertical legs of said at least one anchor; and said at least one anchor secures the plurality of blocks in a multilateral direction, wherein said multilateral direction includes both X axial and Y axial directions, and a vertical Z axial direction is secured from weight of said plurality of blocks on a row of blocks above, whereby a Z axial securement is accomplished by the weight of said plurality of blocks, a Y axial securement is accomplished from said recession of said end wall of each block in said space between the outer leg of said at least one anchor and said inner leg of said at least one anchor by, and an X axial securement from the snug fit of the engagement of sidewalls of the anchor grooves with a recessed surface of complemental anchors, whereby said snug fit of the engagement of the sidewalls of the anchor grooves with a recessed surface of complemental anchors limits X axial movement.

5. The masonry system as recited in claim 4, further comprising:

said combination and engagement of said at least one anchor with said plurality of blocks provides said at least one upper block and said at least one lower block with interlocking anchoring allowing a configurable distance for lateral and vertical spacing above, below, and between all blocks within said plurality of blocks that provides for a standard and uniform spacing.

6. The masonry system as recited in claim 5, further comprising:

mortar included within said spacing above, below, and between all blocks within said plurality of blocks.

7. The masonry system as recited in claim 6, further comprising:

said configurable distance is about a ⅜" space between each block in said plurality of blocks to meet standard masonry construction requirements.

8. The masonry system as recited in claim 6, wherein said block further includes grooves cut into an upper surface and grooves cut in to a lower surfaces, wherein said grooves begin at an inner surface of a vertical cavity of said two vertical cavities and extend to the second internal cavity of said two vertical cavities.

9. The masonry system as recited in claim 8, wherein said grooves are defined by a thickness of the central horizontal member of said at least one anchor, to allow for a complemental fit of said central horizontal member of said at least one anchor within said groove of said at least one block.

10. A masonry system constructed of non-combustible material, comprising:

a plurality of anchors each having three vertical legs attached to a central horizontal member, and two vertical legs attached to said central horizontal member extending in an opposite direction from said three vertical legs, wherein said three vertical legs include a central leg and two outer legs, and said two vertical legs meet said central horizontal member at a connection point opposite of a spacing between said three vertical legs;

a plurality of blocks each having four outer walls and one inner wall defining two internal vertical cavities, wherein said four outer walls include two sidewalls connected by two end walls, and said inner wall connecting to said two sidewalls;

each block in said plurality of blocks having a plurality of anchor grooves per end wall, wherein each anchor groove in said plurality of anchor grooves per end wall is recessed within said end walls of said block, wherein said anchor grooves recess down from an upper surface, up from a lower surface, and in from an outer surface, thereby defining a C-shaped channel per anchor groove bordered by two opposing anchor groove side walls;

each anchor in said plurality of anchors includes two spaces, formed from space created between said inner leg and each of said outer legs of said three vertical legs of each of said anchor in said plurality of anchors, for recessing said end walls, wherein said three vertical legs of each of said anchors in said plurality of anchors are spaced apart from one another a complementary distance to a thickness of said end walls of each block in said plurality of blocks at an area where said thickness of said end wall is thinner from said anchor grooves;

each anchor in said plurality of anchors includes one space, formed from space created between said two vertical legs of said two vertical legs of each anchor in said plurality of anchors, for recessing said inner wall of each block in said plurality of blocks, wherein said two vertical legs of each anchor in said plurality of anchors are spaced apart from one another a complementary distance to a thickness of said inner wall of each block in said plurality of blocks;

a thickness of each leg in said three vertical legs, a thickness of each leg in said two vertical legs, and a thickness of said central horizontal member, are configured for insertion into a complemental anchor groove in said plurality of anchor grooves, wherein each anchor groove in said plurality of anchor grooves is configured for a depth of approximately one-third of the thicknesses of each leg in said three vertical legs, each leg in said two vertical legs, and said central horizontal member;

a combination and engagement of each anchor in said plurality of anchors with said plurality of blocks, wherein said combination and engagement provides for spacing and anchoring of said plurality of blocks when said plurality of blocks are placed end to end and secured with at least one anchor, and further includes:

recession of said end wall of each block, in said plurality of blocks within said space between the outer leg of each anchor in said plurality of anchors and said inner leg of each anchor in said plurality of anchors;

recession of said inner wall of each block in said plurality of blocks within said space between the two vertical legs of each anchor in said plurality of anchors; and each anchor in said plurality of anchors provides multidirectional securement to the plurality of blocks, wherein said multidirectional securement includes both X axial and Y axial lateral securement, and a vertical Z axial securement, whereby said Z axial securement is accomplished by the weight of said plurality of blocks above a row of said plurality of blocks, a Y axial securement is accomplished from said recession of said end wall of each block in said plurality of blocks in said space between the outer leg of each anchor in said plurality of anchors and said inner leg of each anchor in said plurality of anchors, and an X axial securement from a snug fit of the engagement of the two opposing anchor groove side walls of each anchor groove in the plurality of anchor grooves in each block of the plurality of blocks, with recessed surfaces of complemental anchors of said plurality of anchors, whereby said snug fit of the engagement of the sidewalls of the anchor grooves with a recessed surface of complemental anchors limits X axial movement.

11. A method of using a two-part masonry block anchor system in masonry construction, comprising:

providing at least one block having four outer walls and one inner wall defining two internal vertical cavities, wherein said four outer walls include two sidewalls connected by two end walls, said inner wall connecting to said two sidewalls;

providing at least one anchor having three vertical legs attached to a central horizontal member, and two vertical legs attached to said central horizontal member extending in an opposite direction from said three vertical legs, wherein said three vertical legs include a central leg and two outer legs, said two vertical legs meet said central horizontal member at a connection point opposite of a spacing between said three vertical legs, said three vertical legs of said at least one anchor are spaced apart from one another a complementary distance to a thickness of said end walls of said at least one block, said two vertical legs of said at least one anchor are spaced apart from one another a complementary distance to a thickness of said inner wall of said at least one block, each of the at least one anchors includes two spaces, formed from space created between said inner leg and each of said outer legs, for recessing said end walls, and each of the at least one anchor includes one space, formed from space created between said two vertical legs, for recessing said inner wall of said at least one block;

placing a plurality of said at least blocks end to end;

combining and engaging said at least one anchor with said plurality of blocks by securing with at least one anchor, thereby securing the plurality of blocks in a multilateral direction, wherein said multilateral direction includes both X axial and Y axial directions by recessing said sidewall of said at least one block within said space between the outer leg of said at least one anchor and said inner leg of said at least one anchor, and recessing said inner wall of said at least one block within said space between the two vertical legs of said at least one anchor;

administering mortar to a top surface of a block in said plurality of blocks;

placing at least one block on top of a joint of two lower blocks, thereby engaging at least one of said block anchors where the walls of said block are secured between the legs of said block anchors; and securing a vertical Z axial direction with weight of a plurality of blocks on a row of blocks above;

wherein the two-part masonry block anchor system comprises the masonry system of claim 1.

12. The method as recited in claim 11, further comprising:

providing uniform spacing between said least one upper block and said at least one lower block;

including said mortar within spacing above, below, and between all blocks within said plurality of blocks; and configuring a thickness of said three vertical legs, said two vertical legs, and said central horizontal member, for spacing standards between blocks in masonry construction.

13. The method as recited in claim 12, further comprising:

allowing for a complemental fit of said central horizontal member of said at least one anchor within said groove of said block by defining a thickness of said grooves to be comparable to that of at least one anchor's central horizontal member.

14. The method as recited in claim 12, further comprising:

including grooves cut in to an upper surface and grooves cut in to a lower surfaces, wherein said grooves begin at an inner surface of a vertical cavity of said two vertical cavities and extend to the second internal cavity of said two vertical cavities; and allowing for a complemental fit of said central horizontal member of said at least one anchor within said groove of said block by defining a thickness of said grooves to be comparable to that of at least one anchor's central horizontal member.

* * * * *